US008238804B2

(12) United States Patent
Murayama

(10) Patent No.: US 8,238,804 B2
(45) Date of Patent: Aug. 7, 2012

(54) IMAGE FORMING APPARATUS INCLUDING FORMING PORTION CONFIGURED TO FORM IMAGE ON OBJECT, LIGHT RECEIVING PORTION CONFIGURED TO RECEIVE LIGHT FROM DETECTION AREA, AND DETERMINING PORTION CONFIGURED TO DETERMINE POSITION OF MARK IN RELATIVE MOVEMENT DIRECTION OF OBJECT BASED ON COMPARISON

(75) Inventor: Kentaro Murayama, Kasugai (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 1112 days.

(21) Appl. No.: 12/125,652

(22) Filed: May 22, 2008

(65) Prior Publication Data

US 2008/0292370 A1 Nov. 27, 2008

(30) Foreign Application Priority Data

May 25, 2007 (JP) ..... 2007-139067

(51) Int. Cl.
*G03G 15/01* (2006.01)

(52) U.S. Cl. ..... 399/301

(58) Field of Classification Search ..... 399/15, 399/49, 72, 301
See application file for complete search history.

(56) References Cited

U.S. PATENT DOCUMENTS

| | | | | |
|---|---|---|---|---|
| 6,128,459 | A | 10/2000 | Iwata et al. | |
| 6,282,396 | B1 | 8/2001 | Iwata et al. | |
| 6,285,849 | B1 * | 9/2001 | Shimada et al. | 399/301 |
| 6,408,156 | B1 | 6/2002 | Miyazaki et al. | |
| 6,930,786 | B2 | 8/2005 | Kataoka et al. | |
| 7,306,313 | B2 | 12/2007 | Kamimura et al. | |
| 7,916,348 | B2 | 3/2011 | Murayama | |
| 2004/0130737 | A1 | 7/2004 | Kamimura et al. | |
| 2006/0023761 | A1 | 2/2006 | Moriyama | |

FOREIGN PATENT DOCUMENTS

| | | |
|---|---|---|
| JP | 10-198110 | 7/1998 |
| JP | 2000-098810 | 4/2000 |
| JP | 2001-134041 | 5/2001 |
| JP | 2001324849 | 11/2001 |
| JP | 2002304037 | 10/2002 |
| JP | 2003186280 | 7/2003 |
| JP | 2003-316103 | 11/2003 |
| JP | 2004-069801 | 3/2004 |
| JP | 2005031257 | 2/2005 |
| JP | 2006-078691 | 3/2006 |

* cited by examiner

*Primary Examiner* — Walter L Lindsay, Jr.
*Assistant Examiner* — Billy J Lactaoen
(74) *Attorney, Agent, or Firm* — Banner & Witcoff, Ltd.

(57) ABSTRACT

A light receiving portion is configured to receive light that varies with time while a mark formed on an object moves across a detection area. The position of the mark on the object is determined based on comparison of a time-varying level of the light with at least one threshold during movement of the mark on the object across the detection area. The determined position of the mark is corrected by a correction value into a corrected mark position. The correction value is set to a higher value, if the time-varying light level exceeds the threshold or falls below the threshold with a smaller slope while the mark moves across the detection area. An image forming position is adjusted based on the corrected mark position.

20 Claims, 18 Drawing Sheets

IMAGE FORMING APPARATUS INCLUDING FORMING PORTION CONFIGURED TO FORM IMAGE ON OBJECT, LIGHT RECEIVING PORTION CONFIGURED TO RECEIVE LIGHT FROM DETECTION AREA, AND DETERMINING PORTION CONFIGURED TO DETERMINE POSITION OF MARK IN RELATIVE MOVEMENT DIRECTION OF OBJECT BASED ON COMPARISON

CROSS REFERENCE TO RELATED APPLICATION

The present application claims priority from Japanese Patent Application No. 2007-139067 filed on May 25, 2007. The entire content of this priority application is incorporated herein by reference.

TECHNICAL FIELD

The present disclosure relates to an image forming apparatus.

BACKGROUND

A tandem-type image forming apparatus can include photoconductors, which are provided individually for respective colors (such as black, cyan, magenta and yellow). The photoconductors are arranged along the rotational direction of a paper conveyor belt, so that images of respective colors held on the photoconductors can be sequentially transferred to paper on the belt.

A resultant color image formed by the tandem-type image forming apparatus may include a color shift, due to displacement of images of respective colors from one another. In view of this, some of image forming apparatuses have a function for aligning the forming positions of images of respective colors.

During the alignment function being performed, the image forming apparatus forms a registration pattern (i.e., a pattern used for alignment) on the belt, so that an estimated displacement amount of an image formed of each color can be determined based on the registration pattern. The displacement of an image formed of each color is corrected based on the estimated displacement amount.

However, the estimated displacement amounts may fail to be determined accurately in some circumstances, resulting in inaccuracy in final displacement correction.

SUMMARY

The image forming apparatus according to an aspect of the present invention includes a forming portion, a control portion, a light receiving portion, a first determining portion, a correcting portion and an adjusting portion.

The forming portion is configured to form an image on an object based on image data. The object is capable of movement relative to the forming portion. The control portion is configured to provide data of a mark as the above image data for the forming portion. The light receiving portion is configured to receive a light from a detection area, a level of said light varying with time while an image formed on said object moves across said detection area with said relative movement of said object.

The first determining portion is configured to determine the position of the mark in a relative movement direction of the object based on comparison of a time-varying level of said light with at least one threshold during movement of said mark on said object across said detection area.

The correcting portion is configured to correct the determined position of the mark by a correction value into a corrected mark position. The correction value is set to a higher value, if the slope of level change of the light when the level of the light exceeds the threshold or falls below the threshold is smaller while the mark moves across the detection area.

The adjusting portion is configured to adjust the position of an image to be formed by the forming portion based on the corrected mark position.

The position of the mark detected based on the time-varying level of the received light can have an error, which is larger if the time-varying light level exceeds the first threshold or falls below the second threshold with a smaller slope while the mark moves across the detection area. The error in the detected position of the mark could result in inaccuracy in final adjustment of the position of an image to be formed by the forming portion.

In view of this, according to the present invention, the position of the mark determined by the first determining portion is corrected by the correction value, which is set to a higher value (including zero) if the slope of level change of the light is smaller while the mark moves across the detection area. Thereby, degradation in accuracy of adjustment of an image forming position due to variation in detected mark position can be suppressed.

BRIEF DESCRIPTION OF THE DRAWINGS

Illustrative aspects in accordance with the invention will be described in detail with reference to the following drawings wherein.

DETAILED DESCRIPTION

<Illustrative Aspect 1>

An illustrative aspect 1 of an image forming apparatus will be explained with reference to FIGS. 1 to 12.

(General Construction of Printer)

Figure 1:
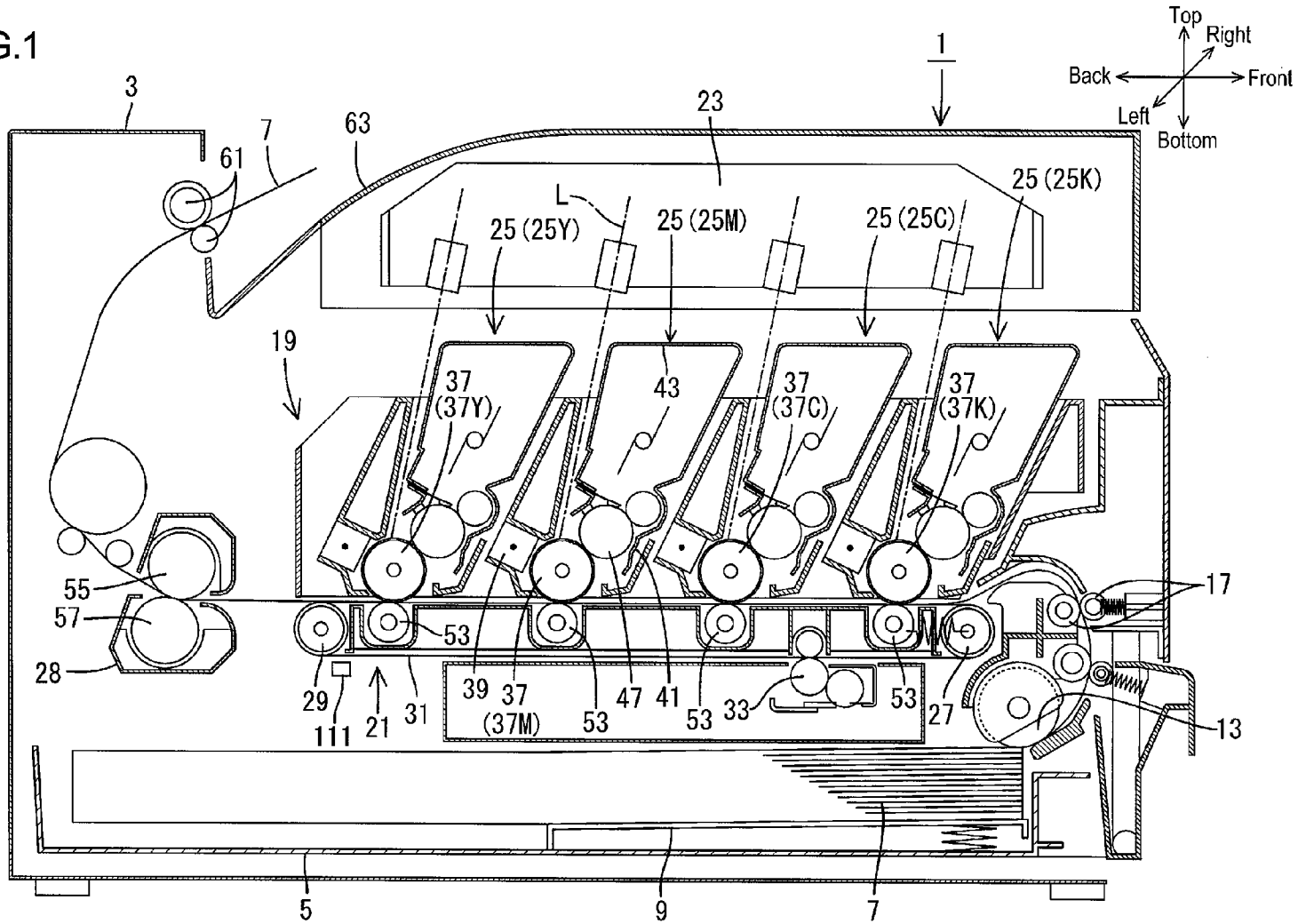
FIG. 1 is a schematic side sectional view of a printer according to an illustrative aspect 1 of the present invention.

FIG. 1 is a schematic sectional side view of a printer 1 according to the present aspect. Hereinafter, the right side of FIG. 1 is referred to as the front side of the printer 1.

The printer 1 (i.e., an example of "an image forming apparatus" of the present invention) is a color laser printer of a direct-transfer tandem type, which has a casing 3 as shown in FIG. 1. A feeder tray 5 is provided on the bottom of the casing 3, and recording media 7 (i.e., paper sheets, plastic sheets, and the like) are stacked on the feeder tray 5.

The recording media 7 are pressed against a pickup roller 13 by a platen 9. The pickup roller 13 forwards the top one of the recording media 7 to registration rollers 17, which forward the recording medium 7 to a belt unit 21. If the recording medium 7 is obliquely directed, it is corrected by the registration rollers 17 before forwarded to the belt unit 21.

An image forming section 19 includes the belt unit 21 (as an example of a conveyor means), a scanner unit 23 (as an example of an exposure means), processing units 25, a fixation unit 28 and the like. In the present aspect, the scanner unit 23 and the processing units 25 function as "a forming portion" of the present invention.

The belt unit 21 includes a belt 31 (as an example of "an object" of the present invention), which is disposed between a pair of support rollers 27, 29. The belt 31 is driven by rotation of the backside support roller 29, for example. Thereby, the belt 31 rotates in anticlockwise direction in FIG. 1, so as to convey the recording medium 7 (forwarded thereto) backward.

A cleaning roller 33 is provided below the belt unit 21, in order to remove toner (including toner of a registration pattern 121 and a corrective pattern 125 described below), paper dust and the like, which can become attached to the belt 31.

The scanner unit 23 includes laser emitting portions (not shown), which are controlled based on image data of the respective colors so as to switch between ON and OFF. Thereby, the scanner unit 23 performs fast scan by radiating laser beams L from the laser emitting portions to the surfaces of photosensitive drums 37.

The photosensitive drums 37 are individually provided for the respective colors as described below, and laser beams L (based on image data of each color) are radiated to the corresponding photosensitive drum 37.

The processing units 25 are provided for the respective colors, i.e., black, cyan, magenta and yellow. The processing units 25 have the same construction, but differ in color of toner (as an example of "a colorant"). Hereinafter, the suffixes K (black), C (Cyan), M (magenta) and Y (Yellow) for indicating colors are attached to symbols of processing units 25, photosensitive drums 37 or the like, when necessary. The suffixes are omitted when not necessary.

Each processing unit 25 includes a photosensitive drum 37 (as an example of an image carrier or a photoconductor), a charger 39, a developer cartridge 41 and the like. The developer cartridge 41 includes a toner container 43, a developer roller 47 (as an example of "a developer image carrier") and the like. The toner container 43 holds toner therein, which is suitably supplied onto the developer roller 47.

The surface of each photosensitive drum 37 is charged homogeneously and positively by the charger 39, and thereafter exposed to laser beams L from the scanner unit 23 as described above. Thereby, an electrostatic latent image (corresponding to an image of the color to be formed on the recording medium 7) is formed on the surface of the photosensitive drum 37.

Next, the toner on the developer roller 47 is supplied to the surface of the photosensitive drum 37 so as to adhere to the electrostatic latent image. Thus, the electrostatic latent image of each color is visualized as a toner image of the color on the photosensitive drum 37.

While the recording medium 7 (being conveyed by the belt 31) passes between each photosensitive drum 37 and the corresponding transfer roller 53 (as an example of a transfer means), a negative transfer bias is applied to the transfer roller 53. Thereby, the toner images on the respective photosensitive drums 37 are sequentially transferred to the recording medium 7, which is then forwarded to the fixation unit 28.

Using a heating roller 55 and a pressure roller 57, the fixation unit 28 heats the recording medium 7 that has the resultant toner image, while forwarding it. Thereby, the toner image is thermally fixed to the recording medium 7. After passing through the fixation unit 28, the recording medium 7 is ejected onto a catch tray 63 by discharge rollers 61.

(Electrical Configuration of Printer)

Figure 2:
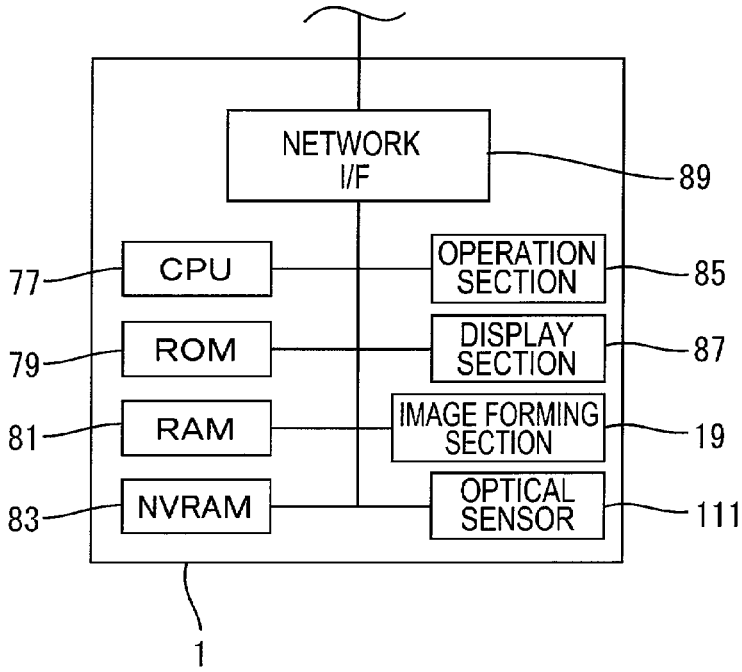
FIG. 2 is a block diagram showing an electrical configuration of the printer.

FIG. 2 is a block diagram showing the electrical configuration of the printer 1. The printer 1 includes a CPU 77, a ROM 79, a RAM 81, an NVRAM 83 (as an example of a storage portion), an operation section 85, a display section 87, the above-described image forming section 19, a network interface 89, optical sensors 111 and the like.

Various programs for controlling the operation of the printer 1 are stored in the ROM 79. The CPU 77 controls the operation of the printer 1 based on the programs retrieved from the ROM 79, while storing the processing results in the RAM 81 and/or the NVRAM 83.

The operation section 85 includes a plurality of buttons. Thereby, a user can perform various input operations, such as an operation for a printing request. The display section 87 can include a liquid-crystal display and indicator lamps. Thereby, various setting screens, the operating condition and the like can be displayed. The network interface 89 can be connected to an external computer (not shown) or the like, via a communication line (also not shown), in order to enable mutual data communication.

(Color Registration Error Correction)

Color registration is useful for a printer capable of forming a color image, such as the present printer 1. This is because a resultant color image may include a color shift if images of respective colors transferred to the recording medium 7 fail to be aligned due to color registration errors. Therefore, color registration error correction (i.e., displacement correction) is performed in order to prevent a color shift.

During a displacement correction process being performed, the CPU 77 of the printer 1 retrieves the data of a registration pattern 121 (shown in FIG. 3) from the NVRAM 83, for example, and provides the retrieved data as image data for the image forming section 19. Thus, the CPU 77 functions as "a control portion" of the present invention.

Figure 3:
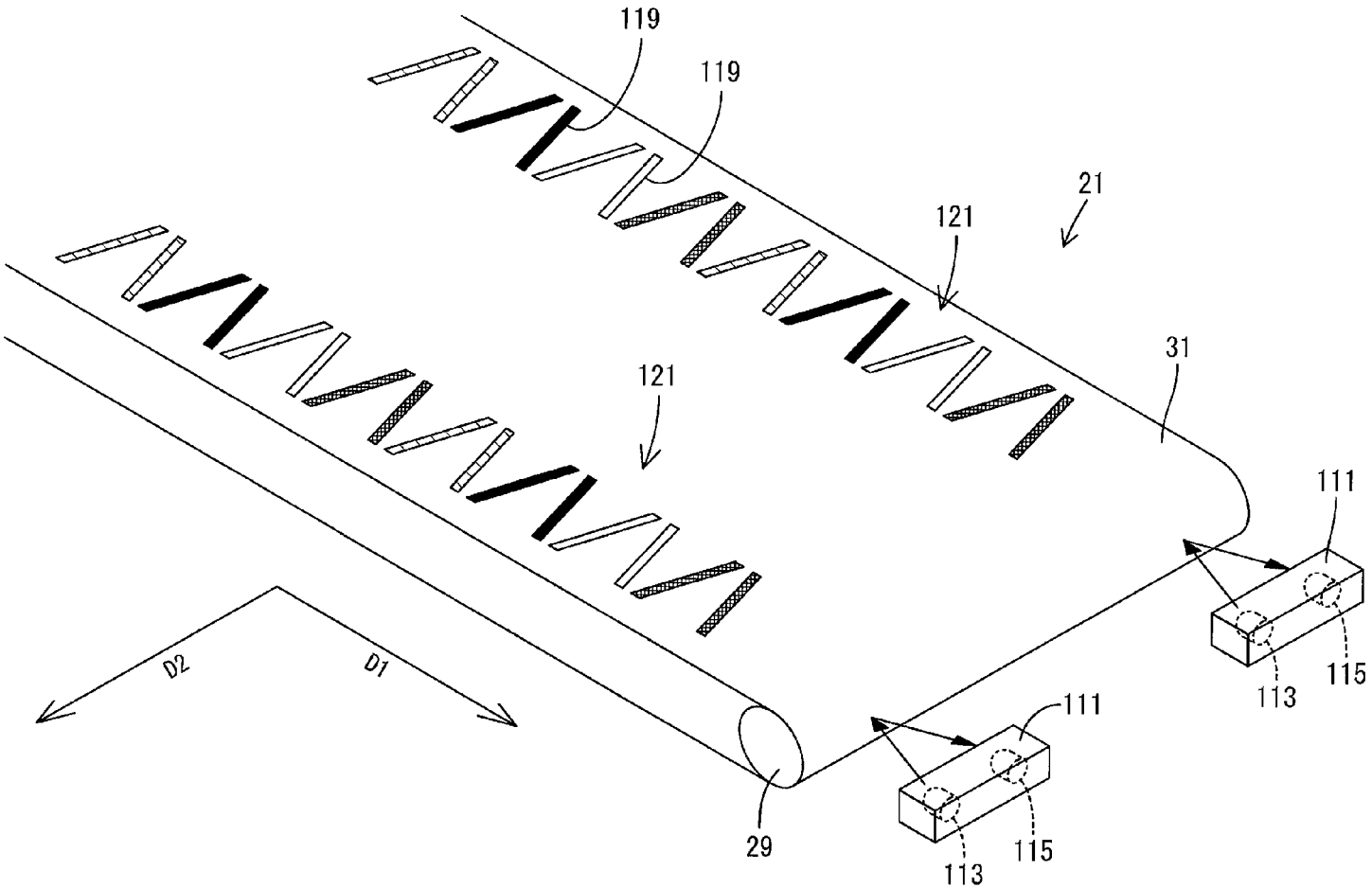
FIG. 3 is a perspective view of optical sensors and a belt.

The image forming section 19 forms the registration pattern 121 on the surface of the belt 31, as shown in FIG. 3. The registration pattern 121 includes a plurality of first marks 119 of the respective colors, which are arranged along a traveling direction (i.e., an example of "a relative movement direction of said object") of the belt 31 (i.e., the front-back direction of the printer 1, and hereinafter referred to as "the secondary scanning direction D1") as described below.

The CPU 77 detects the positions of the first marks 119 by the optical sensors 111 (described below), so that an estimated displacement amount of an image formed of each chromatic color (i.e., yellow, magenta or cyan) from an image formed of the achromatic color (i.e., black) can be determined based on the detected positions of the first marks 119.

In the present aspect, color registration error correction is performed so that an image of each adjustive color (e.g., cyan, magenta or yellow) is aligned with an image of a reference color (e.g., black). The achromatic color (i.e., black) is used as the reference color, while each chromatic color (i.e., cyan, magenta or yellow) is used as an adjustive color, in the present aspect.

A displacement amount (i.e., a conclusive displacement amount described below) is determined for each chromatic color based on the above-described estimated displacement amount.

Using the determined displacement amount, the laser scanning position is corrected so that the displacement is canceled. The laser scanning position means the position on each photosensitive drum 37 where the laser beams L are radiated at, which can be changed for displacement correction by adjusting the timing of emission of laser beams L from the scanner unit 23.

Hereinafter, the color registration error correction (displacement correction) will be explained in more detail, concentrating on how to determine the displacement amount.

1. Optical Sensors

One or a plurality (e.g., two in the present aspect) of optical sensors 111 are provided below the backside portion of the belt unit 21, as shown in FIG. 3. The two optical sensors 111 are arranged along the right-to-left direction. Each of the optical sensors 111 is a reflective sensor that includes a light emitting element 113 (e.g., an LED) and a light receiving element 115 (e.g., a phototransistor).

Specifically, the light emitting element 113 radiates light obliquely to the surface of the belt 31, while the light receiving element 115 receives the light reflected by the surface of the belt 31. The spot area on the belt 31 defined by light from the light emitting element 113 corresponds to the detection area E of the optical sensor 111. The light receiving element 115 is an example of "a light receiving portion" of the present invention.

Figure 4:
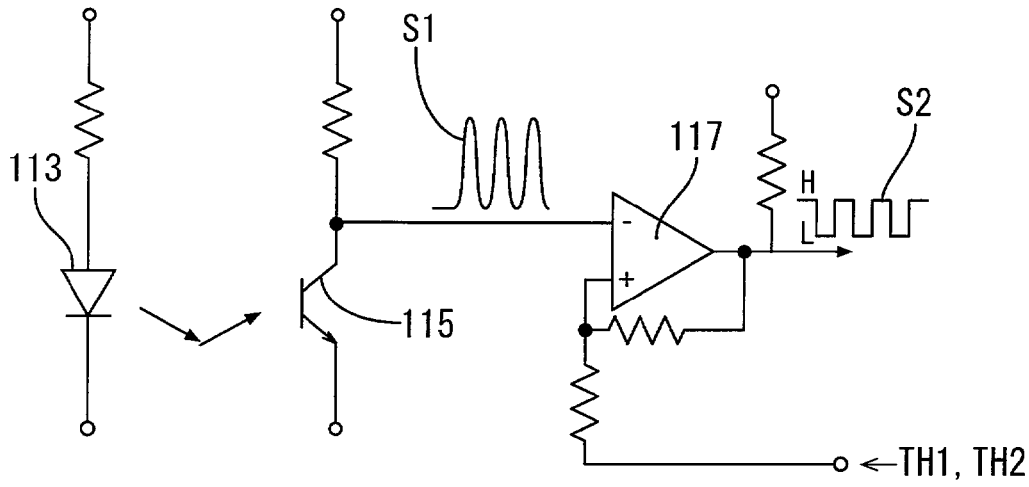
FIG. 4 is a circuit diagram of the optical sensor.

FIG. 4 is a circuit diagram of the optical sensor 111. The light receiving element 115 provides a light sensitive signal S1 according to an amount of light received from the detection area E. In the present aspect, the level of a light sensitive signal S1 is lower when the level of a light amount received by the light receiving element 115 is higher, and is higher when the level of a received light amount is lower.

In the present aspect, the belt 31 is formed of a material that includes polycarbonate or the like, for example. The reflectivity thereof is higher than that of an image formed area. That is, the reflectivity of an exposed area of the belt 31 is higher than that of an area occupied by marks of a registration pattern 121 or a corrective pattern 125 described below.

Therefore, the level of a light sensitive signal S1 is lower when the detection area E includes a larger exposed area of the belt 31, and is higher when the detection area E includes a larger mark-formed area of the belt 31, as described below.

The light sensitive signal S1 is inputted to a hysteresis comparator 117 (an example of a comparator circuit). The hysteresis comparator 117 compares the level of the light sensitive signal S1 with thresholds (i.e., a first threshold TH1 and a second threshold TH2), so as to output a binary signal S2 which is level-inverted based on the result of the comparison.

Specifically, in the present aspect, the binary signal S2 is low level before the level of the light sensitive signal S1 falls below the second threshold TH2 after exceeding the first threshold TH1. Otherwise, it is high level.

2. Registration Pattern of the Present Aspect

Figure 5:
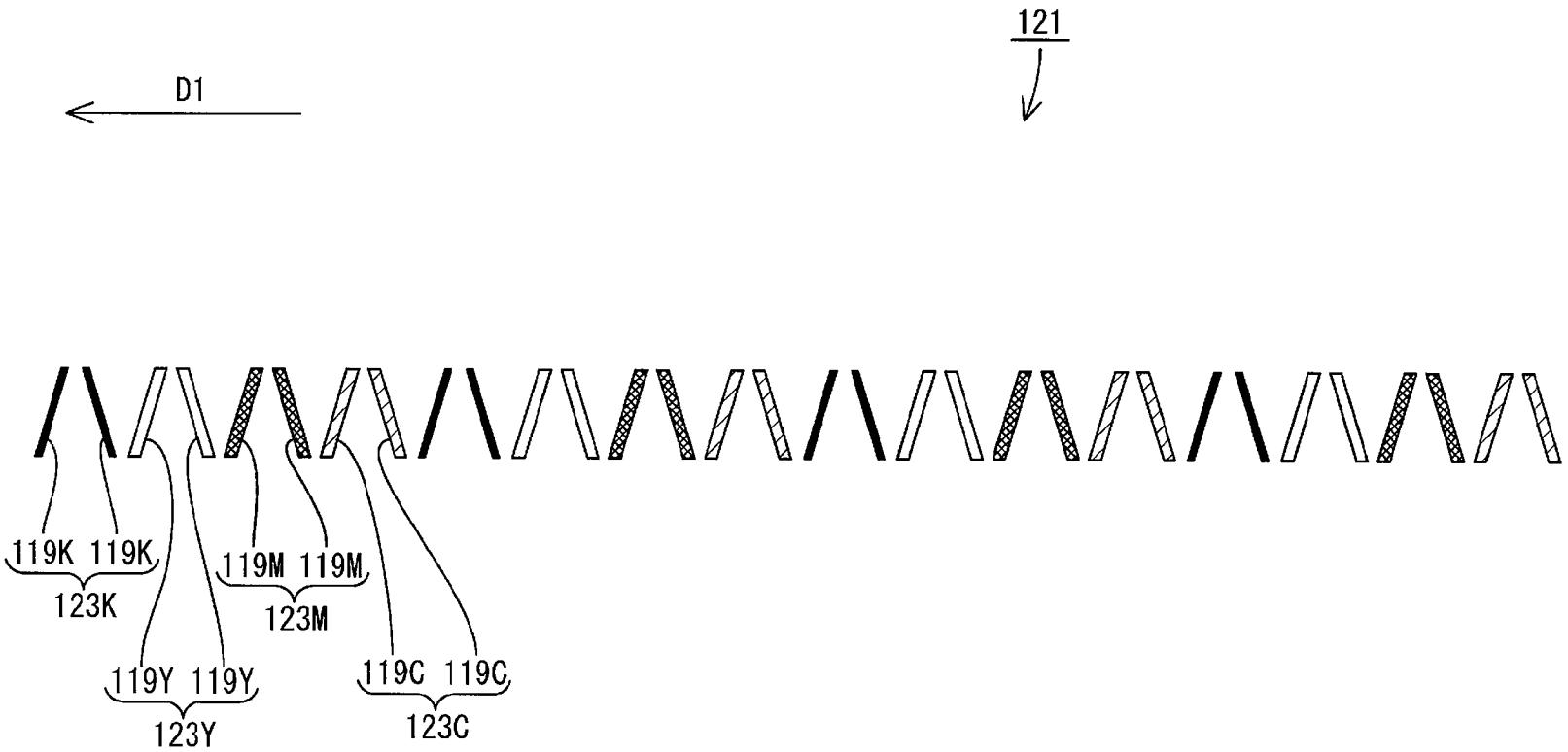
FIG. 5 is a schematic diagram of a registration pattern.

FIG. 5 shows the whole of a registration pattern 121 according to the present aspect. The registration pattern 121 is used for detecting a displacement amount of an image of each color in the secondary scanning direction D1 (parallel to the traveling direction of the belt 31) and in the main scanning direction D2 (perpendicular to the traveling direction).

Specifically, the registration pattern 121 includes one or a plurality (e.g., four in the present aspect) of mark pair groups, which are arranged in the secondary scanning direction D1. Each of the mark pair groups includes a black mark pair 123K, a yellow mark pair 123Y, a magenta mark pair 123M and a cyan mark pair 123C, which are arranged in this order.

Each mark pair 123 (as an example of a first mark pair) includes a pair of first marks 119 (as an example of "a mark" or "a first mark") having a bar-like shape, each of which forms a predetermined angle with the main scanning direction D2. Thereby, the first marks 119 of each mark pair 123 are formed so as to be symmetrical to a line parallel to the main scanning direction D2.

The CPU 77 detects the positions of first marks 119 of each mark pair 123 based on binary signals S2 of the optical sensors 111, so as to determine an estimated displacement amount of an image of each chromatic color from an image of the achromatic color (in the secondary scanning direction D1 and the main scanning direction D2) based on the detected positions of the first marks 119. Hereinafter, the estimated displacement amount determined based on the registration pattern 121 is referred to as "a first displacement amount".

The CPU 77 determines a first displacement amount in the secondary scanning direction D1 as follows. First, the position of each mark pair 123 is determined as the middle position between the first marks 119 of the mark pair 123.

Next, for each mark pair group, a provisional displacement amount of an image of each chromatic color from a black image is calculated as the difference of the detected distance between the chromatic mark pair 123Y, 123M or 123C and the black mark pair 123K from the designed distance therebetween.

Then, the provisional displacement amount associated with each chromatic color is averaged over the registration pattern 121 (i.e., averaged for all mark pair groups), so that the average is determined as a first displacement amount of an image of the chromatic color from a black image in the secondary scanning direction D1.

On the other hand, the CPU 77 determines a first displacement amount in the main scanning direction D2 (i.e., an example of "a first direction") as follows. First, the distance between the first marks 119 of each mark pair 123 is calculated based on the above-described detected positions of the first marks 119.

Hereinafter, the distance between the first marks 119 of a mark pair 123 is referred to as "a first mark distance L1" of the mark pair 123. The first mark distance L1 of a mark pair 123 depends on where the mark pair 123 is positioned on the belt 31 in the main scanning direction D2. That is, the first mark distance L1 of a mark pair 123 indicates the position of the mark pair 123 in the main scanning direction D2. The first mark distance L1 is an example of "a first distance" of the present invention.

For each color, the first mark distance L1 is averaged over the registration pattern 121 (i.e., averaged for all mark pair groups) A first displacement amount of an image of each chromatic color from a black image in the main scanning direction D2 is determined based on the average first mark distances L1 of the respective colors.

In this way, the first displacement amount in the secondary scanning direction D1 is calculated for each chromatic color, and the first displacement amount in the main scanning direction D2 is also calculated for each chromatic color.

However, the first displacement amounts thus determined based on the registration pattern 121 would have variations or errors, due to variation in the detected positions of the first marks 119. Therefore, the first displacement amounts are corrected using correction values in the present aspect. Next, reasons for variation in the detected mark positions and error correction for the detected mark positions will be described.

3. Reasons for Variation in Detected Mark Positions

Figure 6:
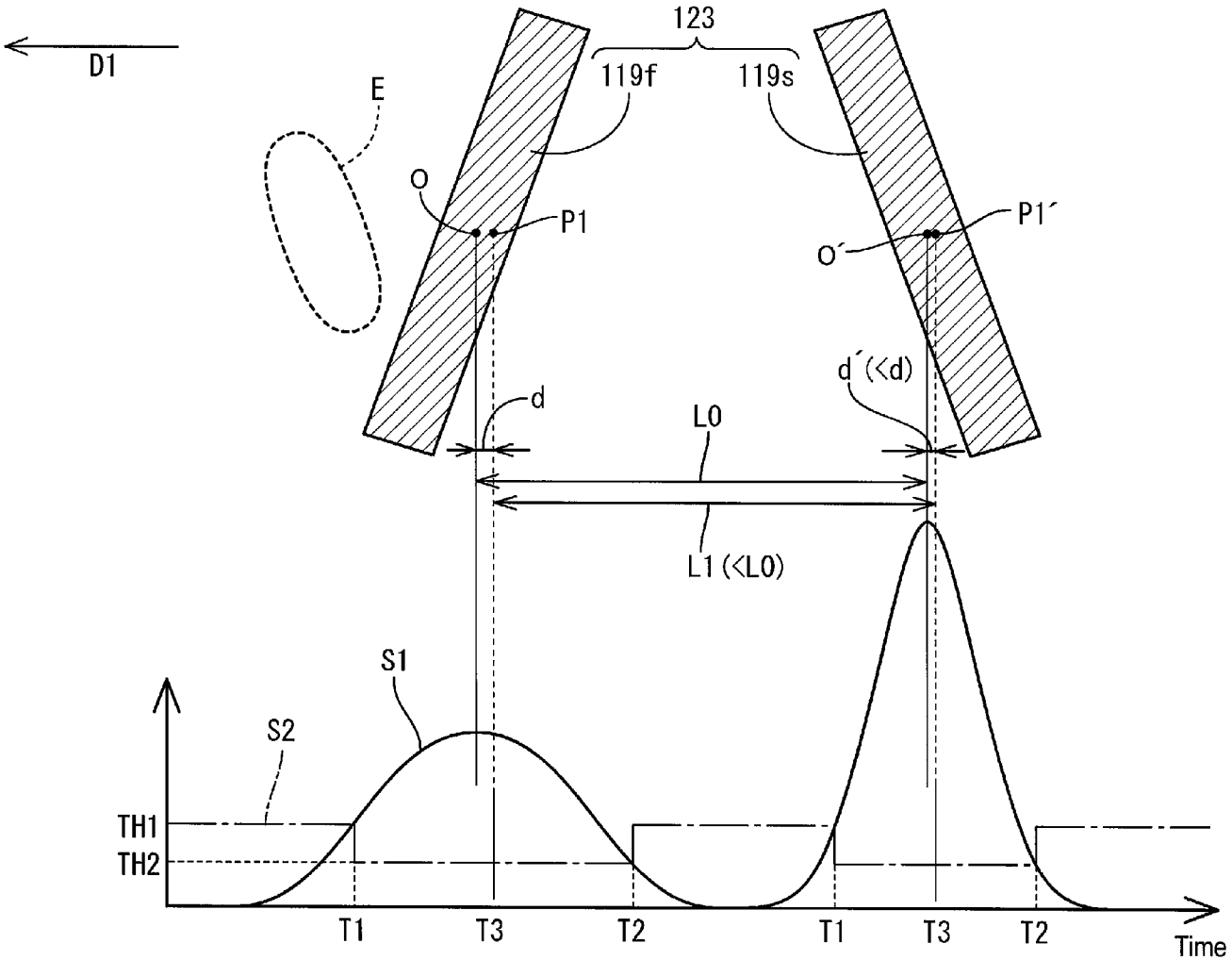
FIG. 6 is a diagram showing a relationship between a mark pair of the registration pattern and a waveform of a light sensitive signal (in a hysteretic case)
Figure 7:
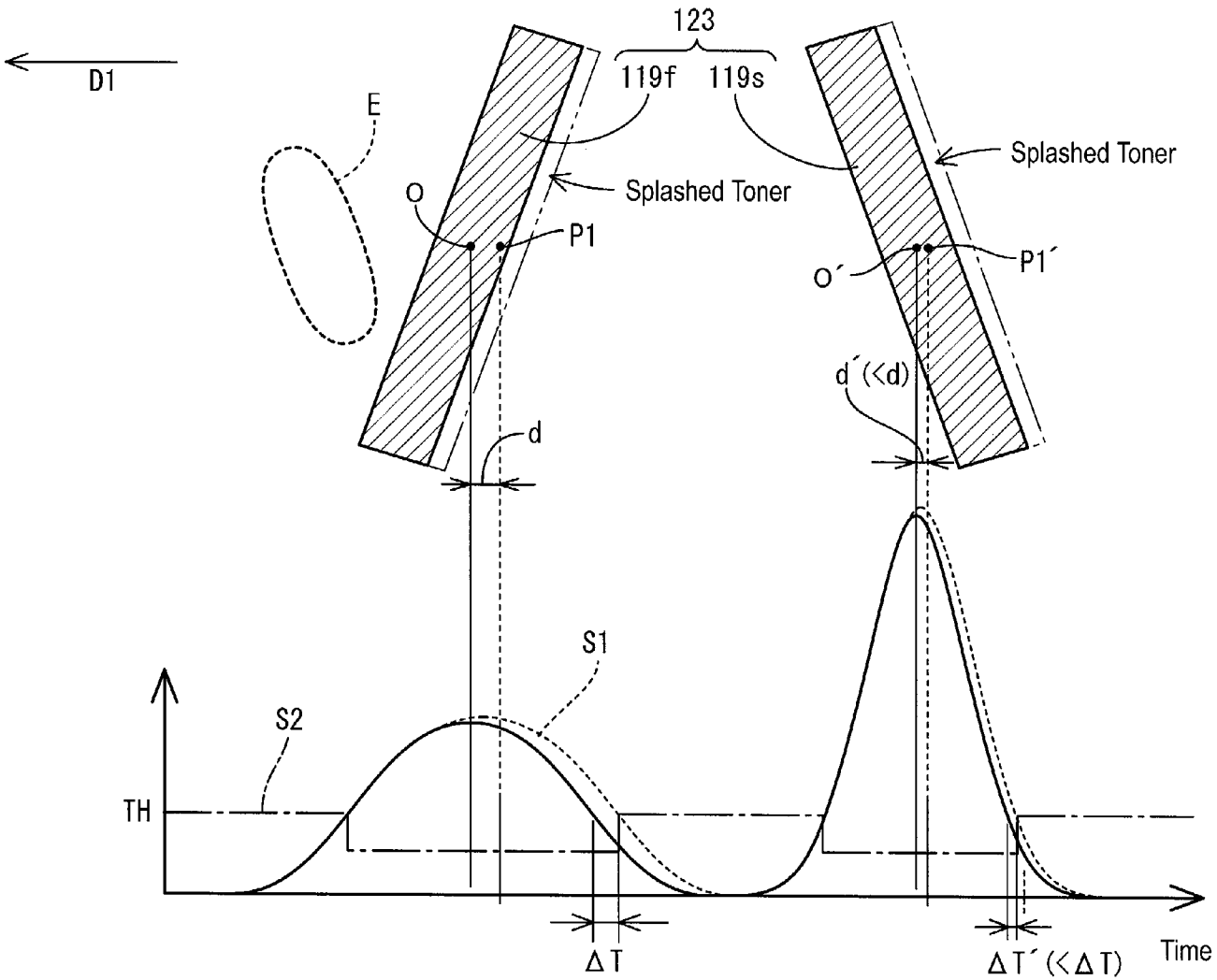
FIG. 7 is a diagram showing a relationship between a mark pair of the registration pattern and a waveform of a light sensitive signal (in a case that toner is prone to splash out of marks)

In FIGS. 6 and 7, the first marks 119*f*, 119*s* of a mark pair 123 are shown as an example in the upper portions of the figures, while a waveform of a light sensitive signal S1 when the first marks 119*f*, 119*s* move across the detection area E is shown in the lower portions of the figures. In each of the figures, the left-hand side thereof is where the secondary scanning direction D1 (i.e., traveling direction of the belt 31) is headed.

The reflectivity of the belt 31 is higher than that of toner (of any of the four colors), as described above. Therefore, the level of light received by the light receiving element 115 is the highest when light from the light emitting element 113 is radiated to an exposed area (i.e., an area where a mark is not formed) of the belt 31, resulting in a light sensitive signal S1 of the lowest level as shown in FIGS. 6 and 7.

In contrast, the level of light received by the light receiving element 115 becomes lower when light from the light emitting element 113 is radiated to a first mark 119*f* or 119*s* formed on the belt 31, resulting in a light sensitive signal S1 of a higher level.

Accordingly, the level of the light sensitive signal S1 varies with time as shown in FIGS. 6 and 7, while the first marks 119*f*, 119*s* formed on the belt 31 move relative to the detection area E.

The positions of the first marks 119*f*, 119*s* are detected based on the binary signals S2 as described above, i.e., based on comparison of the time-varying level of the light sensitive signal S1 with the first threshold TH1 and the second threshold TH2.

The detected positions of the first marks 119*f*, 119*s* may have variation, for example, due to the following reasons (1) and (2):

(1) Two different thresholds (i.e., the first threshold TH1 and the second threshold TH2) are used so that detection of the first marks 119 involves hysteresis (still under the condition that the slope of level change of a light sensitive signal S1 when the level exceeds or falls below the first or second threshold TH1, TH2 (hereinafter, referred to as "a slope of level change of a light sensitive signal S1") differs depending on first marks 119 to be detected); and (2) Toner is prone to splash out of first marks 119 formed on the belt 31 (still under the condition that the slope of level change of a light sensitive signal S1 differs depending on first marks 119 to be detected).

The difference in slope of level change of a light sensitive signal S1 is mainly due to the difference in peak value thereof, which corresponds to each first mark 119. The difference in peak value corresponding to each first mark 119 is partly because first marks 119 form different angles with respect to the shape of the detection area E.

It is preferable that the detection area E is formed to be perfectly round. However, actually, the detection area E may fail to be round due to the mounting location of the light emitting element 113 and/or the light receiving element 115 or variation in characteristics thereof, resulting in an oval detection area elongated in a predetermined direction.

In this case, two first marks 119*f*, 119*s* of a mark pair 123 form different angles with the elongated direction of the detection area E from each other. Consequently, the peak value and therefore the slope of level change of a light sensitive signal S1 differ between the two first marks 119*f*, 119*s*.

Specifically, referring to FIG. 6, the first-printed first mark 119*f* (i.e., the left-side mark in the figure) of a mark pair 123 can be formed so as to intersect with the elongated direction of the detection area E. Therefore, a light sensitive signal S1 varies relatively gradually so as to form a wide waveform as a whole, while the first mark 119*f* moves across the detection area E. That is, the slope of level change of the light sensitive signal S1 is small, when the first-printed first mark 119*f* is detected.

In contrast, the second-printed first mark 119*s* (i.e., the right-side mark in the figure) of the mark pair 123 can be formed so as to extend along the elongated direction of the detection area E. Therefore, a light sensitive signal S1 varies relatively steeply so as to form a spindly waveform as a whole, while the first mark 119*s* moves across the detection area E. That is, the slope of level change of the light sensitive signal S1 is large, when the second-printed first mark 119*s* is detected.

FIG. 6 shows one mark pair 123 as an example, as described above, and the same goes for the other mark pairs 123. That is, the slope of level change of a light sensitive signal S1 differs between two first marks 119*f*, 119*s* of each mark pair 123. Further, the slope of level change of a light sensitive signal S1 also differs among the mark pairs 123.

That is, the difference in slope of level change of a light sensitive signal S1 can further result from differences in reflectivities of first marks 119. The reflectivity differs depending on the color or density of a first mark 119.

The reflectivity of black first marks 119K is lower than that of chromatic first marks 119C, 119M or 119Y. That is, the reflectivity of black first marks 119K differs greatly from that of the belt 31, while the reflectivity of chromatic first marks 119C, 119M or 119Y differs slightly from that of the belt 31.

Therefore, on the condition that first marks 119K, 119C, 119M and 119Y of respective colors have the same shape, the same size and the same density (defined as the number of dots per unit area, for example), the peak value and therefore the slope of level change of a light sensitive signal S1 are larger when a black first mark 119K is detected, compared to when a chromatic first mark 119C, 119M or 119Y is detected.

Concerning the above reason (1), the position of a first mark 119*f* or 119*s* is estimated based on an intermediate time point T3 that is right at the middle point between a time T1 when the level of a light sensitive signal S1 exceeds the first threshold TH1 and a time T2 (when the level thereafter falls below the second threshold TH2), in the present aspect.

That is, referring to FIG. 6, the positions P1 and P1' on the belt 31 are determined as the estimated positions of the first marks 119*f*, 119*s*. The estimated position of the first-printed first mark 119*f* is shifted from the actual center position O of the first mark 119*f* by a distance d, while the estimated position of the second-printed first mark 119*s* is shifted from the actual center position O' thereof by a distance d'.

The distance d is longer than the distance d', because the slope of level change of the light sensitive signal S1 during detection of the first-printed first mark 119*f* is smaller than that during detection of the second-printed first mark 119*s*.

Thus, the shift amount of the detected position P1 or P1' from the actual center position O or O' differs between the first marks 119*f*, 119*s* of each mark pair 123, and thereby the first mark distance L1 of each mark pair 123 may fail to be determined accurately. This greatly affects accuracy in detection of a displacement amount particularly in the main scanning direction D2, which is determined based on the first mark distance L1.

Concerning the above reason (2), toner is sometimes prone to splash to rearward of first marks 119*f*, 119*s* along the secondary scanning direction D1 as shown in FIG. 7. In this case, the detected positions of the first marks 119*f*, 119*s* may have variation due to splashed toner, even if the first threshold TH1 and the second threshold TH2 are supposedly set to the same value TH as shown in FIG. 7.

More specifically, the waveform of a light sensitive signal S1 when a first mark 119*f* or 119*s* with a toner-splashed area is detected may have an increased width, as shown by a dotted line in FIG. 7. The width of the waveform during detection of the first-printed first mark 119*f* is increased by an increment ΔT, while the width of the waveform during detection of the second-printed first mark 119*s* is increased by an increment ΔT'.

The increment ΔT is larger than the increment ΔT', even when the toner-splashed area abutting on the first-printed first mark 119*f* has the same width as the toner splashed area abutting on the second-printed first mark 119*s*.

Therefore, in this case (2), the shift amount of the detected position P1 or P1' from the actual center position O or O' also differs between the first marks 119*f*, 119*s* of each mark pair 123, as in the above case (1).

4. Error Correction for Detected Mark Positions

Figure 9:
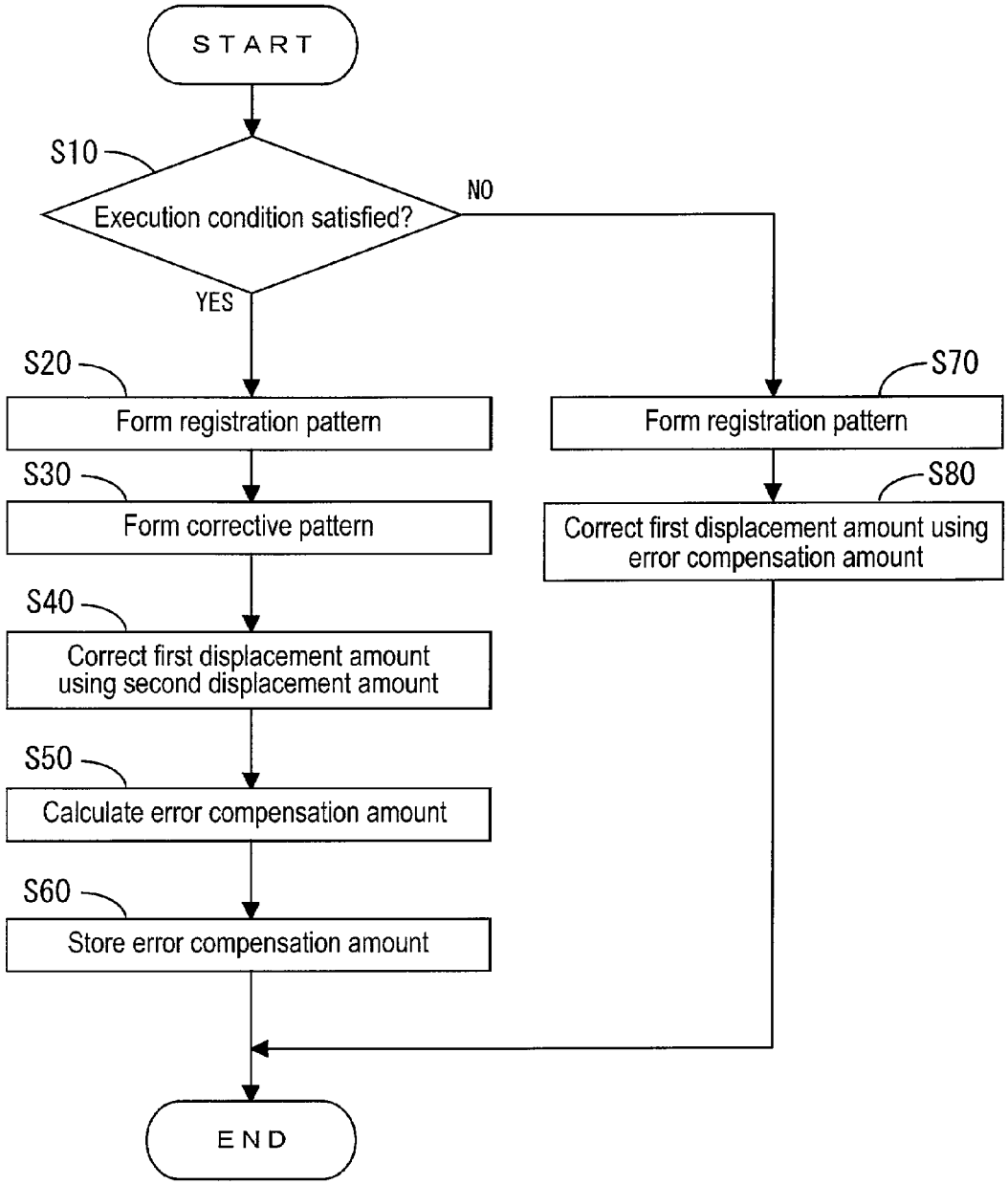
FIG. 9 is a flowchart of a displacement correction process.

FIG. 9 shows a displacement correction process including error correction for detected mark positions. The error correction is performed in order to compensate for variation of detected mark positions. That is, the detected positions of first marks 119 are corrected using correction values by the error correction.

Figure 8:
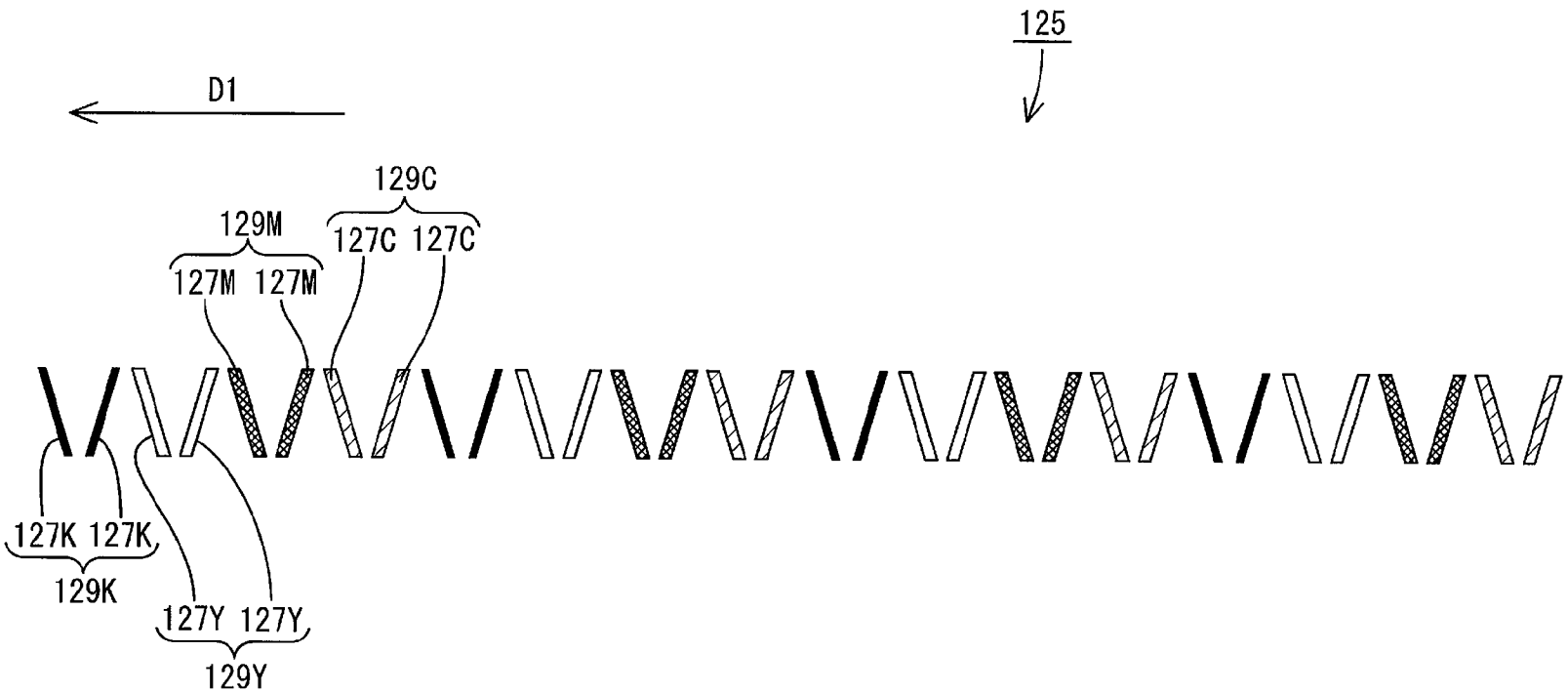
FIG. 8 is a schematic diagram of a corrective pattern.

Specifically, a corrective pattern 125 shown in FIG. 8 is formed on the belt 31, so that correction values can be determined based on the corrective pattern 125. The corrective pattern 125 includes a plurality of mark pairs 129 (as second mark pairs), each of which includes a pair of second marks 127. The number of mark pairs 129 included in the corrective pattern 125 is equal to the number of mark pairs 123 included in a registration pattern 121, in the present aspect.

The shape and colors of a corrective pattern 125 are symmetrical to the shape and colors of a registration pattern 121 with respect to a line parallel to the secondary scanning direction D1. That is, the second marks 127 of each mark pair 129 of the corrective pattern 125 are symmetrical to the first marks 119 of the corresponding mark pair 123 of the registration pattern 121.

Another estimated displacement amount of an image formed of each chromatic color from an image formed of the achromatic color is determined based on the corrective pattern 125. Hereinafter, an estimated displacement amount determined based on the corrective pattern 125 is referred to as "a second displacement amount".

The first displacement amounts determined based on the registration pattern 121 are corrected using the second displacement amounts.

During the correction, a higher correction value with respect to the error canceling direction is used for correcting the position of a first mark 119 having been detected based on a light sensitive signal S1 that varies with a smaller slope.

That is, if the slope of level change of a light sensitive signal S1 during detection of a first mark 119 is smaller, the detected position of the first mark 119 is corrected using a higher correction value with respect to the error canceling direction.

Next, a displacement correction process according to the present aspect will be explained with reference to FIG. 9, and the details of the above error correction for the detected mark positions will be described in the explanation about step S40.

The following explanation will be concentrated on displacement correction in the main scanning direction D2. Displacement correction in the secondary scanning direction D1 can be performed in a similar manner.

The CPU 77 initiates a displacement correction process at a predetermined time. For example, the displacement correction process is started when the elapsed time or the number of printed recording media since previous execution of the displacement correction process (i.e., more specifically, previous execution of step S40 or S80 described below) reaches a first reference value.

First, it is determined at step S10 whether an execution condition is satisfied. The execution condition is that the elapsed time or the number of printed recording media since previous execution of correction based on a corrective pattern 125 (i.e., correction executed at step S40) reaches a second reference value (larger than the first reference value), for example. The CPU 77 executing step S10 functions as "a decision portion" of the present invention.

If the CPU 77 determines that the execution condition is satisfied (i.e., "Yes" is determined at step S10), the data of a registration pattern 121 is retrieved from the NVRAM 83, and provided sequentially for the image forming section 19 at step S20.

Figure 10A:
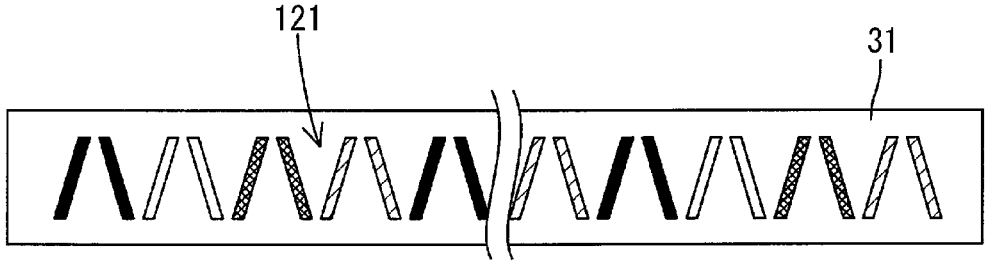
FIG. 10A is a schematic top view of the belt on which a registration pattern is formed.
Figure 10B:
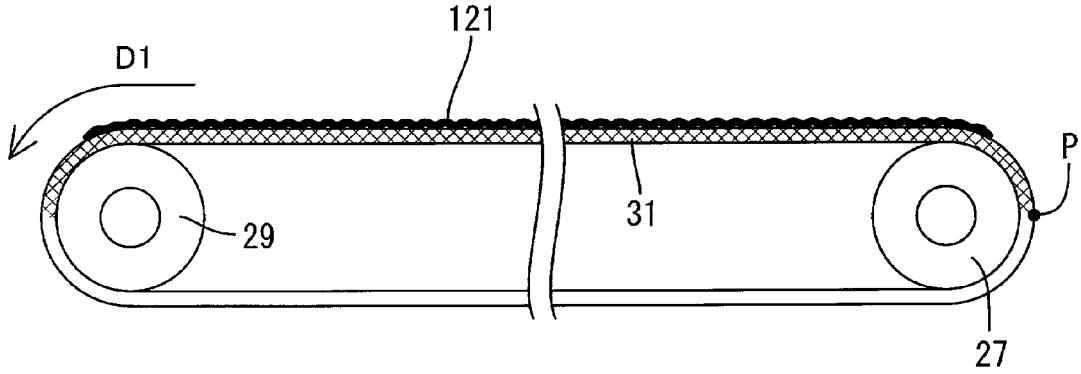
FIG. 10B is a schematic side view of the belt on which the registration pattern is formed.

In response to this, the image forming section 19 forms a registration pattern 121 on the belt 31, as shown in FIGS. 10A and 10B. The formation of the registration pattern 121 is started when a reference point P of the belt 31 is at a predetermined position on the backside support roller 29 side.

FIGS. 10A and 10B are top and side views of the belt 31, respectively, which show the status when the belt 31 has finished one and a half revolutions after the start of the formation, in order to improve understandability of the shape of the registration pattern 121.

The CPU 77 obtains binary signals S2, which are sequentially outputted from the optical sensors 111 during detection of the registration pattern 121 formed on the belt 31. The estimated positions of first marks 119 of each mark pair 123 are determined based on the binary signals S2, and then the above-described first mark distance L1 of each mark pair 123 (i.e., the distance between the first marks 119*f*, 119*s* shown in FIG. 6) is calculated based on the estimated positions of the first marks 119.

The first mark distance L1 of a mark pair 123 depends on where the mark pair 123 is positioned in the main scanning direction D2, as described above. Therefore, an estimated displacement amount of an image formed of each chromatic color from an image formed of the achromatic color can be calculated using the first mark distances L1 of mark pairs 123 of the registration pattern 121.

An estimated displacement amount calculated at step S20 corresponds to a first displacement amount described above, and hereinafter is referred to as "a first displacement amount D1Y, D1M, or D1C". The CPU 77 calculating the first displacement amounts D1Y, D1M and D1C at step S20 functions as "a first determining portion" of the present invention.

The registration pattern 121 formed on the belt 31 is removed by activating the cleaning roller 33, after the CPU 77 obtains the binary signals S2 generated based on the first marks 119.

Figure 11A:
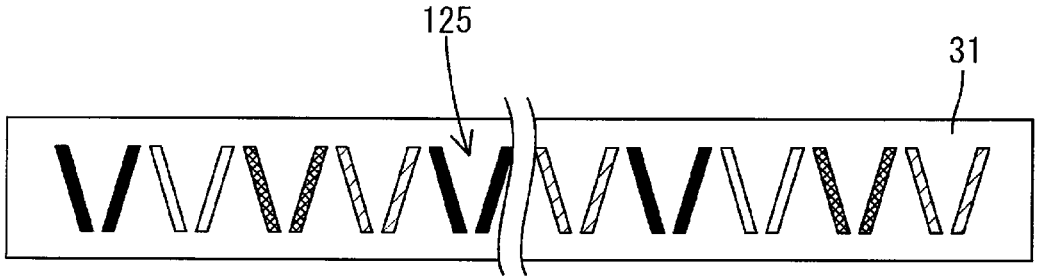
FIG. 11A is a schematic top view of the belt on which a corrective pattern is formed.
Figure 11B:
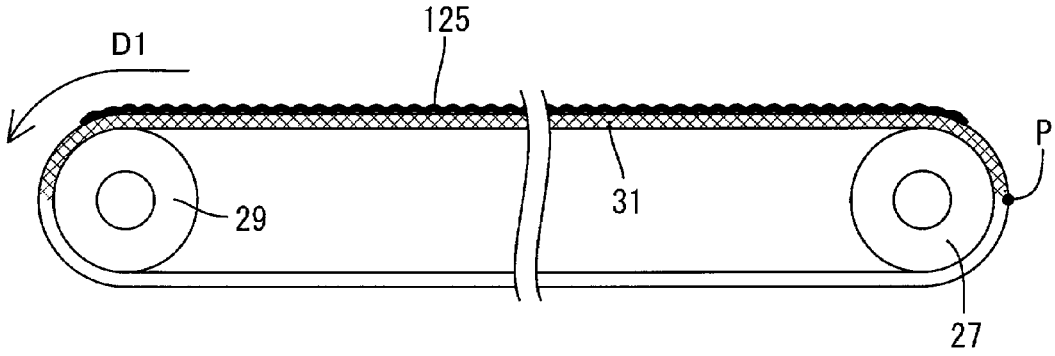
FIG. 11B is a schematic side view of the belt on which the corrective pattern is formed.

Next, at step S30, the data of a corrective pattern 125 is retrieved from the NVRAM 83, and provided sequentially for the image forming section 19. In response to this, the image forming section 19 forms a corrective pattern 125 on the belt 31, as shown in FIGS. 11A and 11B. Alternatively, step S30 may be executed before step S20.

The formation of the corrective pattern 125 is started when the reference point P is at the above predetermined position on the backside support roller 29 side. Thereby, the corrective pattern 125 is formed on an area of the belt 31 where the registration pattern 121 is formed at step S20.

For example, an encoder (not shown) is provided for outputting a pulse signal according to the rotational speed of the support roller 27 or 29 in the present aspect. The traveling distance of the belt 31 can be obtained by counting the number of pulses of the pulse signal, and thereby the CPU 77 can detect when the reference point P of the belt 31 returns to the predetermined position. This enables the CPU 77 to know when formation of the corrective pattern 125 should be started.

Figure 12:
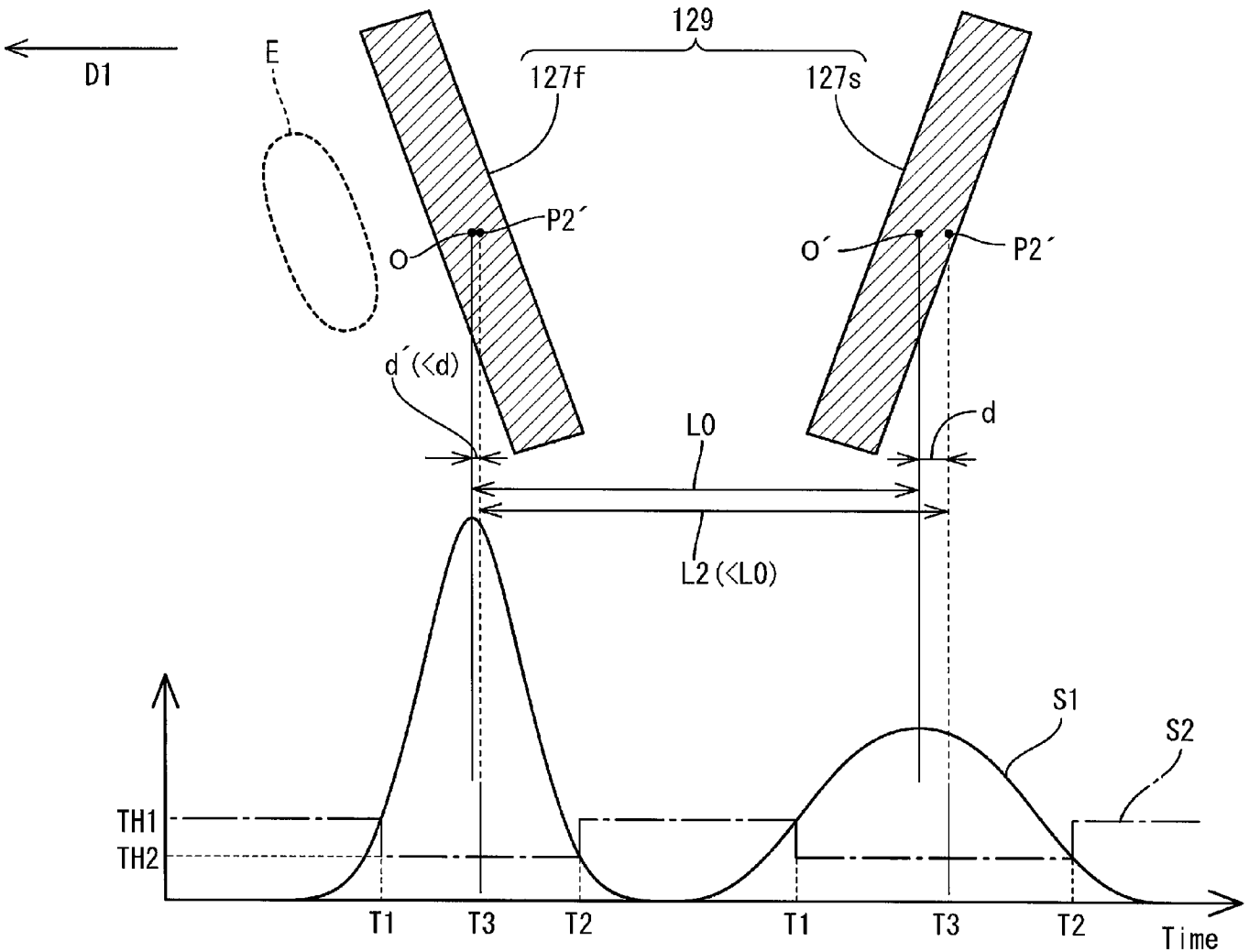
FIG. 12 is a diagram showing a relationship between a mark pair of the corrective pattern and a waveform of a light sensitive signal (in a hysteretic case)

FIGS. 11A and 11B are top and side views of the belt 31, respectively, which show the status when the belt 31 has finished one and a half revolutions after the start of the formation, in order to improve understandability of the shape of the corrective pattern 125. FIG. 12 shows the second marks 127*f*, 127*s* of a mark pair 129 as an example, and further shows a waveform of a light sensitive signal S1 obtained when the second marks 127*f*, 127*s* move across the detection area E.

The CPU 77 obtains binary signals S2, which are sequentially outputted from the optical sensors 111 during detection of the corrective pattern 125 formed on the belt 31.

Referring to FIG. 12, the estimated positions P2, P2' of second marks 127*f*, 127*s* of each mark pair 129 are determined based on the binary signals S2, and then the distance between the second marks 127*f*, 127*s* of each mark pair 129 is calculated based on the estimated positions P2, P2' of the second marks 127*f*, 127*s*.

Hereinafter, the calculated distance between the second marks 127*f*, 127*s* of a mark pair 129 is referred to as "a second mark distance L2" of the mark pair 129. The second mark distance L2 is an example of "a second distance" of the present invention.

For each chromatic color, an estimated displacement amount of an image formed of the chromatic color from an image formed of the achromatic color is calculated at step S30 using the second mark distances L2 of mark pairs 129 of the corrective pattern 125.

An estimated displacement amount calculated at step S30 corresponds to a second displacement amount described above, and hereinafter is referred to as "a second displacement amount D2Y, D2M, or D2C". The CPU 77 calculating the second displacement amounts D2Y, D2M and D2C at step S30 functions as "a first determining portion" of the present invention.

Next, at step S40 of FIG. 9, the first displacement amounts D1Y, D1M and D1C are corrected using the respective second displacement amounts D2Y, D2M and D2C. Specifically, for each chromatic color, an average value ADY, ADM or ADC of the first displacement amount D1Y, D1M or D1C and the second displacement amount D2Y, D2M or D2C is calculated as a conclusive displacement amount DY, DM or DC of an image of the chromatic color from an image of the achromatic color. The CPU 77 executing step S40 functions as "a correcting portion" and "a displacement determining portion" of the present invention. The conclusive displacement amount DY, DM or DC is an example of "an estimated displacement amount" of the present invention.

Referring to FIG. 6, the first mark distance L1 of each mark pair 123 calculated at step S20 should be equal to (L0−d+d') where L0 is the actual mark distance (i.e., the distance between actual center positions O, O' of first marks 119*f*, 119*s* of the mark pair 123 formed on the belt 31), as described above. That is, the first mark distance L1 should be shorter than the actual mark distance L0, due to variation in the detected positions of the first marks 119*f*, 119*s*.

For example, if the actual mark distance L0 and the distances d and d' are 10 dots, 3 dots and 1 dot, respectively, the first mark distance L1 calculated at step S20 is 8 dots because 10−3+1=8. In this case, referring to FIG. 12, the second mark distance L2 calculated at step S30 is 12 dots because 10−1+3=12.

The first mark distance L1 corresponds to the distance between −3(=−d) dot position (with respect to the actual center position O of the first-printed first mark 119*f*) and −1(=−d') dot position (with respect to the actual center position O' of the second-printed first mark 119*s*), as shown in FIG. 6.

The second mark distance L2 corresponds to the distance between −1(=−d') dot position (with respect to the actual center position O of the first-printed second mark 127*f*) and −3(=−d) dot position (with respect to the actual center position O' of the second-printed second mark 127*s*), as shown in FIG. 12.

A first displacement amount and the corresponding second displacement amount are averaged at step S40, as described above. That is, at step S40, the estimated position of the first-printed first mark 119*f* of a mark pair 123 is corrected to shift from −3 dot position to −2 (=(−d+(−d'))/2) dot position with respect to its actual center position O, while the estimated position of the second-printed first mark 119*s* of the mark pair 123 is corrected to shift from −1 dot position to −2(=(−d'+(−d))/2) dot position with respect to its actual center position O'.

A conclusive displacement amount DY, DM or DC calculated at step S40 is considered to be a displacement amount determined based on the distance (i.e., corrected distance) between the corrected estimated positions of the first marks 119*f*, 119*s* of each mark pair 123 (e.g., based on the distance between −2 dot position (with respect to the actual center position O of the first-printed first mark 119*f*) and −2 dot position (with respect to the actual center position O' of the second-printed first mark 119*s*)).

That is, a conclusive displacement amount DY, DM or DC can be determined based on distances equal to actual mark distances L0 of mark pairs 123. Thereby, the conclusive displacement amounts DY, DM and DC calculated at step S40 can be accurate.

Note that the estimated position of the first-printed first mark 119*f* is corrected by +1 dot as a correction value (i.e., changed from −3 dot position to −2 dot position), while the estimated position of the second-printed first mark 119*s* is corrected by −1 dot as a correction value (i.e., changed from −1 dot position to −2 dot position).

Thus, in the present aspect, the correction value (e.g. +1) used for correcting the first-printed first mark 119*f* of a mark pair 123 is higher than the correction value (e.g. −1) used for correcting the second-printed first mark 119*s* of the mark pair 123. That is, a higher correction value with respect to the error canceling direction is used for correcting the estimated position of a first mark 119*f* having been determined based on a light sensitive signal S1 that varies with a smaller slope, as described above.

The corrected estimated position of each first mark 119*f*, 119*s* (e.g. −2 dot position with respect to its actual center position O or O') is an example of "a corrected mark position" of the present invention.

The conclusive displacement amount DY, DM or DC calculated at step S40 indicates an estimated position of an image of a chromatic color relative to an image of the achromatic color. In future operations for image formation, the positions of images of respective chromatic colors on a recording medium are corrected based on the conclusive displacement amounts DY, DM and DC.

Specifically, when the scanner unit 23 emits laser beams L for forming image of respective chromatic colors, timing of the emission is adjusted so that the conclusive displacement amounts DY, DM and DC are canceled. Thus, the CPU 77 functions as "an adjusting portion" of the present invention.

Returning to FIG. 9, at step S50, error compensation amounts CDY, CDM and CDC are calculated. The error compensation amounts CDY, CDM and CDC are used for correcting first displacement amounts D1Y, D1M and D1C determined based on a registration pattern 121 during future execution of a displacement correction process.

For example, an error compensation amount CDY, CDM or CDC can be determined by subtracting a first displacement amount D1Y, D1M or D1C from a conclusive displacement amount DY, DM or DC. That is, the error compensation amount CDY, CDM or CDC can be determined as (D2Y−D1Y)/2, (D2M−D1M)/2 or (D2C−D1C)/2.

Alternatively, a common error compensation amount for all the chromatic colors may be determined as the error compensation amounts CDY, CDM and CDC. The common error compensation amount can be calculated as {(D2Y+D2M+D2C)−(D1Y+D1M+D1C)}/6, for example.

The error compensation amounts CDY, CDM and CDC calculated at step S50 are stored in the NVRAM 83 at step S60. Then, the present displacement correction process terminates. The CPU 77 executing step S50 functions as "a third determining portion" of the present invention.

If it is determined at step S1 that the execution condition is not satisfied (i.e., "NO" is determined at step S10), a registration pattern 121 is formed on the belt 31 at step S70, and first displacement amounts D1Y, D1M and D1C are calculated based on the first mark distances L1 of mark pairs 123 of the registration pattern 121.

Note that "NO" is determined at step S10 when the elapsed time or the number of printed recording media since previous execution of displacement correction has reached the first reference value but that since previous execution of correction using a corrective pattern 125 is not up to the second reference value.

In this case, conclusive displacement amounts DY, DM and DC for respective chromatic colors can be determined without forming a corrective pattern 125, as follows.

The first displacement amounts D1Y, D1M and D1C calculated at step S70 are corrected at step S80 using the respective error compensation amounts CDY, CDM and CDC stored in the NVRAM 83. For example, (D1Y+CDY), (D1M+CDM) and (D1C+CDC) are calculated at step S80 as respective conclusive displacement amounts DY, DM and DC. Then, the present displacement correction process terminates.

In future operations for image formation, the positions of images of respective chromatic colors on a recording medium are corrected based on the conclusive displacement amounts DY, DM and DC.

(Effect of the Present Illustrative Aspect)

According to the present aspect, the first displacement amounts D1Y, D1M, D1C determined based on a registration pattern 121 are corrected using the second displacement amounts D2Y, D2M, D2C determined based on a corrective pattern 125, which is symmetrical to the registration pattern 121 with respect to a line parallel to the secondary scanning direction D1.

According to this construction, if a light sensitive signal S1 (during detection of a first mark 119) varies with a smaller slope, a light sensitive signal S1 during detection of the corresponding second mark 127 varies with a larger slope. The opposite is also true.

Thereby, referring to FIGS. 6 and 12, the detected position P1 of the first-printed first mark 119*f* of each mark pair 123 varies in a similar manner to the detected position P2' of the second-printed second mark 127*s* of the corresponding mark pair 129, while the detected position P1' of the second-printed first mark 119*s* varies in a similar manner to the detected position P2 of the first-printed second mark 127*f*.

Accordingly, the detected position P1 of the first-printed first mark 119*f* is corrected positively in the secondary scanning direction D1 by use of the detected position P2 of the corresponding second mark 127*f*, while the detected position P1' of the second-printed first mark 119*s* is corrected negatively in the secondary scanning direction D1 by use of the detected position P2' of the corresponding second mark 127*s*.

That is, assuming that the secondary scanning direction D1 is a positive direction, a higher correction value is used for correcting the estimated position P1 of a first mark 119 having been determined based on a light sensitive signal S1 that varies with a smaller slope, in the present aspect.

Thereby, errors of the detected positions of first marks 119 are properly canceled by errors of the detected positions of second marks 127. Consequently, degradation in accuracy of displacement correction due to variation in detected mark positions can be suppressed.

The belt 31 in itself involves displacement or movement fluctuation (such as meandering) when rotating, and the fluctuation is cyclic. According to the present aspect, a registration pattern 121 is formed on the belt 31 during a cycle, and a corrective pattern 125 is formed during another cycle on an area of the belt 31 where the registration pattern 121 is formed. Thereby, effect from the cyclic fluctuation of the belt 31 can be mitigated, and consequently degradation in accuracy of displacement correction can be suppressed.

If the distance between the first marks 119 of each mark pair 123 or the distance between the second marks 127 of each mark pair 129 is set to be relatively long, first mark distances L1 or second mark distances L2 detected based thereon may include errors due to the above displacement or movement fluctuation of the belt 31.

In view of this, the first marks 119 of each mark pair 123 are formed as adjacent marks on the belt 31 without an intervening mark, and the second marks 127 of each mark pair 129 are also formed as adjacent marks, in the present aspect. Thereby, effect from the fluctuation of the belt 31 can be mitigated.

Toner usage for displacement correction could be increased if correction by use of a corrective pattern 125 (i.e., strict correction executed at step S40 of FIG. 9) is performed during every execution of a displacement correction process. Further, displacement correction with an adequate accuracy can be achieved, even if strict correction by use of a corrective pattern 125 is not performed during every execution of a displacement correction process.

That is, it is preferable that strict correction is performed after a considerable time has elapsed (e.g. after correction without using a corrective pattern 125 has been performed several times) since previous execution of strict correction.

For this reason, in the present aspect, correction for the detected mark positions is performed using error compensation amounts stored in the NVRAM 83 (without forming a corrective pattern 125), if it is determined that the execution condition is not satisfied at the start of a displacement correction process (i.e., "NO" is determined at step S10). Thereby, toner usage for displacement correction can be reduced.

<Illustrative Aspect 2>

An illustrative aspect 2 will be explained with reference to FIGS. 13 to 16. The difference from the above illustrative aspect 1 is in the construction of a corrective pattern used at step S30 of FIG. 9 and in a method for determining second displacement amounts based on the corrective pattern.

The other constructions are similar to the above aspect 1, and therefore designated by the same symbols as the above aspect 1. Redundant explanations are omitted, and the following explanation will be concentrated on the difference.

(Corrective Pattern)

Figure 13:
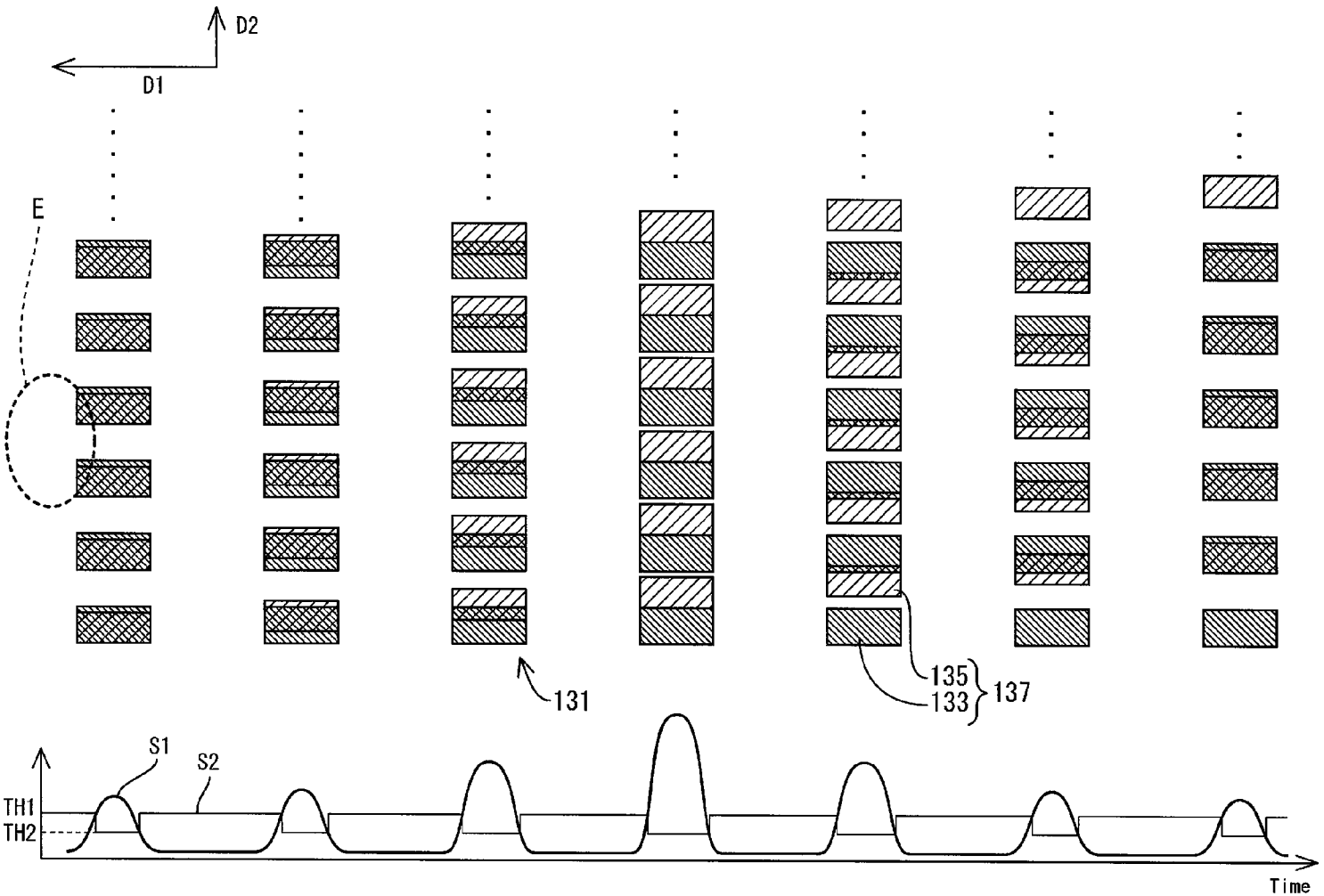
FIG. 13 is a schematic diagram showing a corrective pattern of an illustrative aspect 2, accompanied by a signal waveform diagram of a light sensitive signal.

In the present aspect, a corrective pattern 131 (as an example of "a pattern") shown in FIG. 13 is formed on the belt 31 at step S30 of FIG. 9. The corrective pattern 131 includes mark pairs 137, each of which includes a mark 133 of a reference color (e.g., black) and a mark 135 of an adjustive color (e.g., cyan, magenta or yellow).

The mark pairs 137 are arranged in an array of rows and columns, i.e., arranged in the secondary scanning direction D1 and the main scanning direction D2, as shown in FIG. 13. The mark pairs 137 arranged in a row (i.e., arranged in the secondary scanning direction D1) differ from one another in shift amount of the adjustive-color mark 135 from the reference-color mark 133 (hereinafter, referred to as "a mark shift amount"). In contrast, the mark shift amount is the same in the mark pairs 137 arranged in a column.

In the present aspect, the mark shift amount is the smallest on the first-printed side of a row of the mark pairs 137, and gets larger at the last-printed side, as shown in FIG. 13. Consequently, the overlap between the reference-color mark 133 and the adjustive-color mark 135 is the largest on the first-printed and last-printed sides of a row, and the smallest right at the middle of the row.

The difference between the mark shift amounts of adjacent mark pairs 137 (i.e., the minimal difference between the mark shift amounts of two mark pairs 137) is set to be constant (e.g., a value corresponding to two dots) over the entire row, in the present aspect. However, the difference need not necessarily be uniform over the entire row.

Further, in the present aspect, the reference-color mark 133 and the adjustive-color mark 135 of each mark pair 137 differ from each other in width (i.e., in length in the main scanning direction D2). The difference in width corresponds to one dot, for example.

(Determination of Second Displacement Amount)

Figure 14:
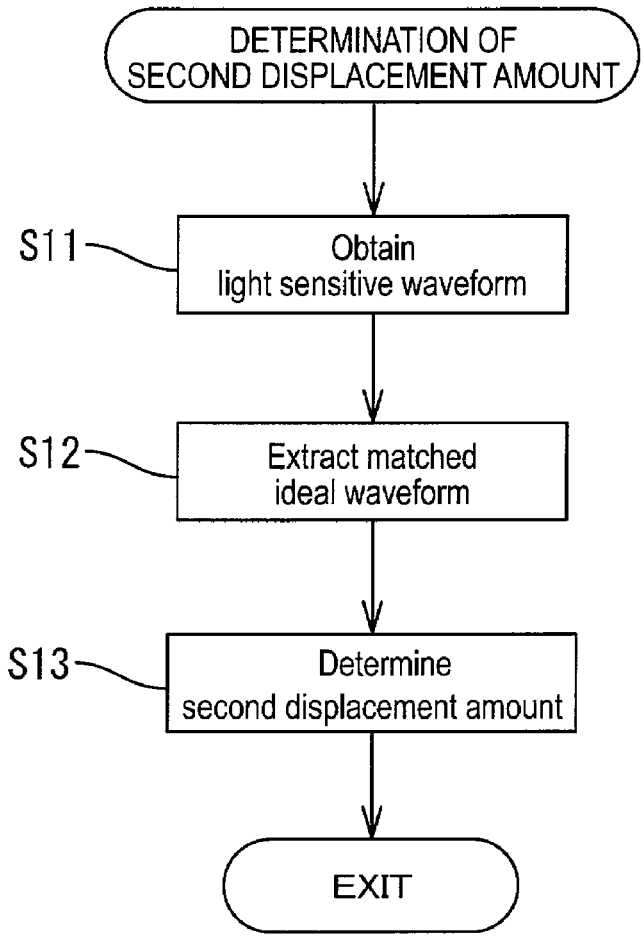
FIG. 14 is a flowchart of a process for determination of a second displacement amount.

FIG. 14 shows a process for determination of a second displacement amount D2Y, D2M or D2C based on a corrective pattern 131, which is executed at step S30 of FIG. 9. The CPU 77 obtains a light sensitive waveform (shown as Graph W1 in FIG. 15) at step S11 based on binary signals S2 from the optical sensors 111 while causing the image forming section 19 to form a corrective pattern 131 on the belt 31. Hereinafter, the light sensitive waveform obtained at step S11 is referred to as "a sampled light sensitive waveform W1".

Note that the light amount reflected from each detection area E depends on the area of overlap between the reference-color mark 133 and the adjustive-color mark 135 of a mark pair 137 present in the detection area E.

That is, when the overlap is large, the exposed area of the belt 31 is large and therefore the light amount reflected from the detection area E is large. Therefore, in this case, the level of a light sensitive signal S1 is low as described in the above aspect 1, and the pulse width of the binary signal S2 is small as shown in FIG. 13.

The pulse width of the binary signal S2 is a duration of the binary signal S2 being low level, which corresponds to a length of time before the light sensitive signal S1 falls below the second threshold TH2 after exceeding the first threshold TH1, as described above.

On the other hand, when the overlap between the reference-color mark 133 and the adjustive-color mark 135 of a mark pair 137 present in the detection area E is small, the exposed area of the belt 31 is small and therefore the light amount reflected from the detection area E is small. Therefore, in this case, the level of the light sensitive signal S1 is high as described above, and the pulse width of the binary signal S2 is large as shown in FIG. 13.

At step S11, the CPU 77 obtains the above-described sampled light sensitive waveform W1 based on the pulse widths of the binary signals S2, which correspond to the areas of overlaps as described above. Specifically, the sampled light sensitive waveform W1 can be obtained based on the average of the pulse widths of the binary signals S2 from the two optical sensors 111.

Next, at step S12, a matched ideal waveform W2' (shown in FIG. 15) is extracted from a plurality of ideal waveforms W2 stored in the NVRAM 83. That is, an ideal waveform most approximate to the sampled light sensitive waveform W1 (obtained at step S11) is extracted from the ideal waveforms W2. The ideal waveforms W2 are ideal light sensitive waveforms, which are free from effect of noise or the like.

The ideal waveforms W2 can be obtained by modifying a sampled light sensitive waveform obtained beforehand (preferably when noise has not occurred), for example. The obtained ideal waveforms W2 are stored as two-dimensional data (i.e., data in the coordinate system having a pulse-width scale and a time scale as axes) in the NVRAM 83.

The plurality of ideal waveforms W2 have different phases, i.e., they are time-shifted from one another. The phase difference $\Delta t1$ (shown in the lower graph of FIG. 15) between two adjacent ideal waveforms W2 is set to be smaller than the sampling interval $\Delta t2$ of the sampled light sensitive waveform W1 (i.e., the time interval between two adjacent data points in the upper graph of FIG. 15). Thereby, the displacement amount can be determined in a unit smaller than the minimal difference between the mark shift amounts, as described below.

The NVRAM 83 further stores a data table (i.e., an example of relation information) that shows a correspondence relation between ideal waveforms and displacement amounts. Each of the displacement amounts in the data table indicates an estimated displacement amount of an image of the adjustive color in the main scanning direction D2, which can be associated with a corresponding one of the ideal waveforms W2.

That is, an ideal waveform W2, which is most approximate to a sampled light sensitive waveform obtained when reference-color marks 133 and adjustive-color marks 135 are formed without color registration error, is set as a reference ideal waveform, and the displacement amount corresponding thereto is set to zero. As for the other ideal waveforms W2, the displacement amounts corresponding thereto are set based on the phase differences between the ideal waveforms and the reference ideal waveform.

Alternatively, the NVRAM 83 may store the correspondence relation as a formula indicating the relationship between the phases of ideal waveforms W2 and the displacement amounts, instead of the data table. In this case, the estimated displacement amount can be calculated using the formula based on the phase of an ideal waveform W2 selected as a matched ideal waveform W2'.

Returning to FIG. 14, at step S12, a matched ideal waveform W2' as an ideal waveform W2 approximate to the sampled light sensitive waveform W1 (obtained at step S11) is extracted from the plurality of ideal waveforms W2 as described above, based on degree of coincidence with the sampled light sensitive waveform W1. Specifically, in the present aspect, an inner product method is used for the extraction as follows.

Assuming that (PW1, t1) represents a coordinate value of the sampled light sensitive waveform W1 while (PWx, tx) represents a coordinate value of the ideal waveforms W2 (where "PW1" and "PWx" are values on the pulse-width scale, "t1" and tx" are values on the time scale, and "x" represents the identification number of each ideal waveform W2), the CPU 77 calculates $\Sigma(PW1 \cdot PWx + t1 \cdot tx)$ for each ideal waveform W2.

That is, for each ideal waveform W2, the CPU 77 calculates the sum total of inner products of the data points on the sampled light sensitive waveform W1 and the corresponding data points on the ideal waveform W2. Each sum total is calculated using data of the sampled light sensitive waveform W1 within a cycle thereof. If the sum total calculated for an ideal waveform W2 is large, it can be determined that the degree of coincidence between the ideal waveform W2 and the sampled light sensitive waveform W1 is high.

Figure 15:
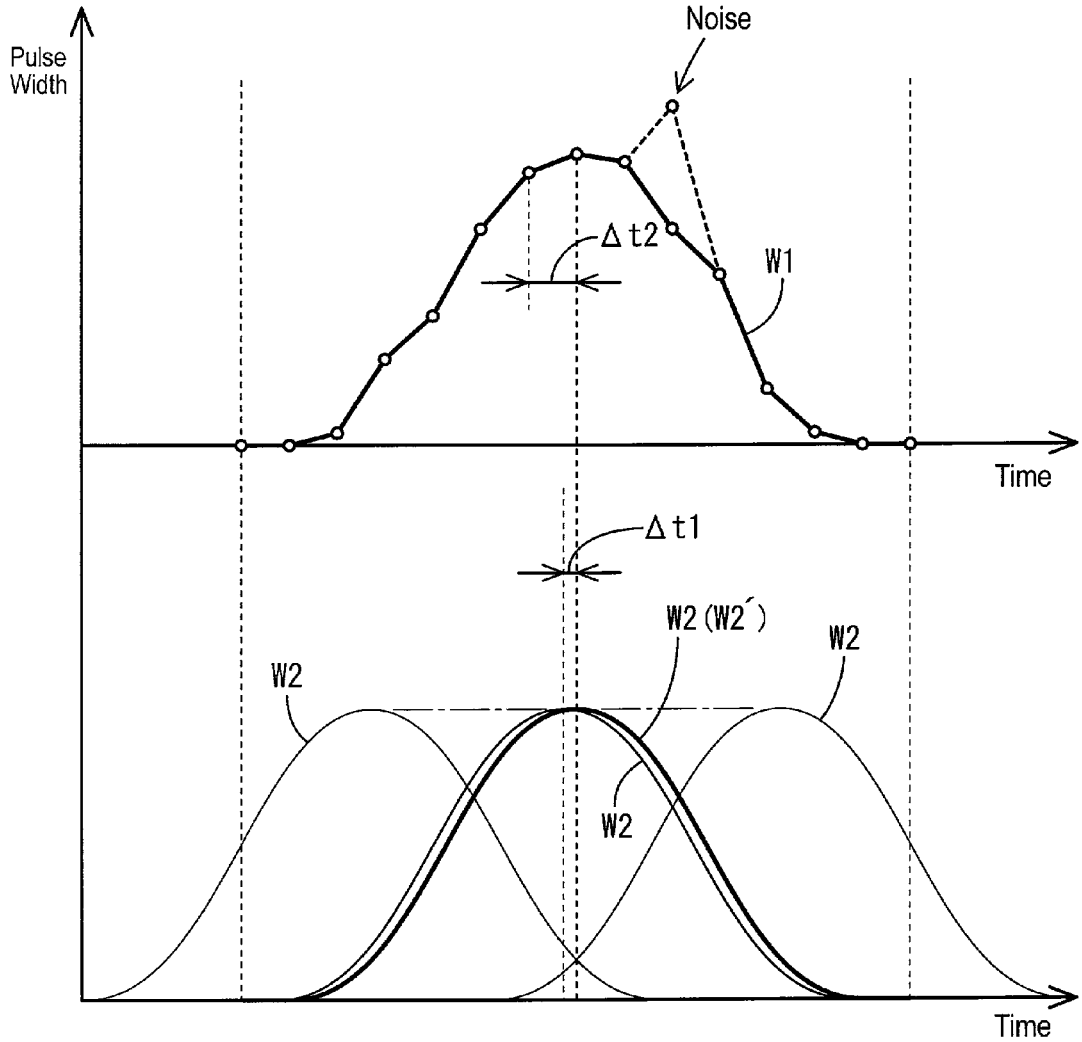
FIG. 15 is a graph showing a sampled light sensitive waveform and ideal waveforms.

In the present aspect, an ideal waveform W2 corresponding to the largest sum total is extracted as a matched ideal waveform W2' (shown by a heavy line in the lower graph of FIG. 15).

Next, at step S13, the CPU 77 determines the displacement amount of the adjustive-color marks 135 from the reference-color marks 133 (as a second displacement amount D2Y, D2M or D2C), using the matched ideal waveform W2', as follows. The CPU 77 executing step S13 functions as "a fourth determining portion" of the present invention.

When the reference-color marks 133 and the adjustive-color marks 135 are formed without color registration error (as shown in FIG. 13), the above-described reference ideal waveform W2 is extracted as a matched ideal waveform W2' at step S12, and therefore "zero" as the displacement amount corresponding thereto is retrieved from the data table in the NVRAM 83 and determined as the displacement amount of the adjustive-color marks 135 (i.e., as a second displacement amount D2Y, D2M or D2C) at step S13.

On the other hand, when the reference-color marks 133 and the adjustive-color marks 135 are formed so as to be displaced from each other in the main scanning direction D2 due to color registration error (i.e., when the column of the corrective pattern 131, on which the overlaps between the reference-color marks 133 and the adjustive-color marks 135 are the largest, is shifted from that shown in FIG. 13), the phase of the sampled light sensitive waveform W1 shifts from that of the reference ideal waveform W2.

That is, an ideal waveform W2 other than the reference ideal waveform W2 is extracted as a matched ideal waveform W2' at step S12, and therefore the displacement amount corresponding thereto (i.e., a value not equal to zero) is retrieved from the data table in the NVRAM 83 and determined as the displacement amount of the adjustive color marks 135 (i.e., as a second displacement amount D2Y, D2M or D2C) at step S13.

Note that the minimal phase difference Δt1 between the ideal waveforms W2 is smaller than the sampling interval Δt2 of the sampled light sensitive waveform W1, as described above. Therefore, the minimal difference between displacement amounts corresponding to the ideal waveforms W2 is smaller than the minimal difference between mark shift amounts of the mark pairs 137. Thereby, the second displacement amount can be determined at step S13 in a unit smaller than the minimal difference between the mark shift amounts.

In the present aspect, for each of the three chromatic colors, a corrective pattern 131 including reference-color marks 135 of the achromatic color and adjustive-color marks 135 of the chromatic color is formed on the belt 31 and a process for determination of a second displacement amount (described above) is executed. That is, second displacement amounts D2Y, D2M and D2C are determined individually for the respective chromatic colors.

In the present aspect, a plurality of ideal waveforms W2 are provided individually for different chromatic colors. That is, the ideal waveforms W2 stored in the NVRAM 83 are different for different adjustive colors. This is because a sampled light sensitive waveform W1 obtained using the optical sensors 111 differs depending on the color.

For example, referring to FIG. 1, an image of cyan is formed by the processing unit 25C disposed on the upstream side. Therefore, reference-color marks 133 of black and adjustive-color marks 135 of cyan (or specifically, the whole or edges thereof) are slightly extended while passing between the downstream-side photosensitive drums 37M, 37Y and the corresponding transfer rollers 53.

Figure 16:
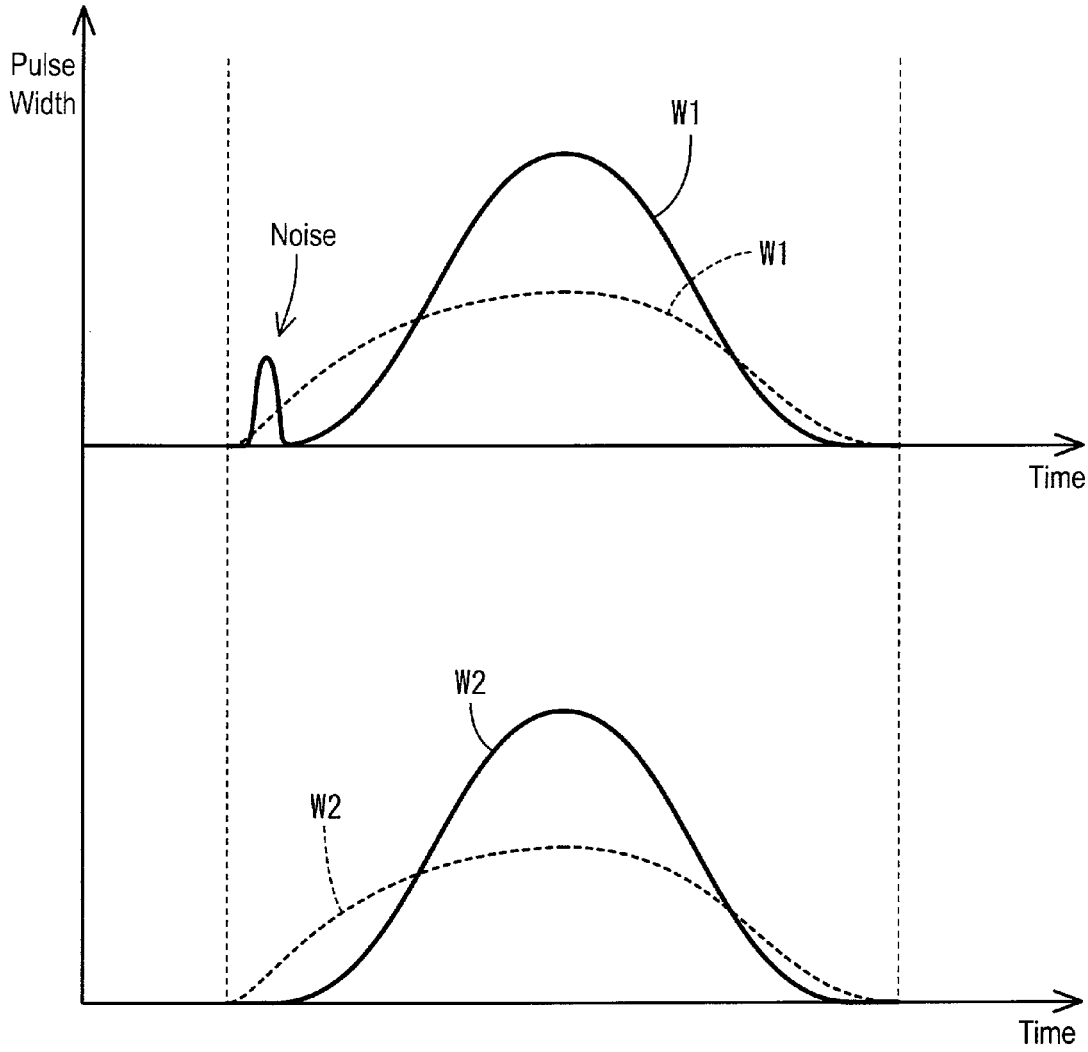
FIG. 16 is a graph showing sampled light sensitive waveforms associated with two respective adjustive colors, and further showing ideal waveforms prepared for the two respective adjustive colors.

Thereby, a sampled light sensitive waveform W1 obtained based on a corrective pattern 131 including reference-color marks 133 of black and adjustive-color marks 135 of cyan is small in height and large in width, as shown by a dotted line in the upper graph of FIG. 16.

In contrast, a sampled light sensitive waveform W1 obtained based on a corrective pattern 131 including reference-color marks 133 of black and adjustive-color marks 135 of magenta or yellow is large in height and small in width, as shown by a solid line in the upper graph of FIG. 16.

If an ideal waveform W2 having a small height for cyan (as shown by a dotted line in the lower graph of FIG. 16) is used indifferently for determining the second displacement amount based on a corrective pattern 131 including adjustive-color marks 135 of magenta, inner products calculated at step S12 are susceptible to noise that can be included in the sampled light sensitive waveform W1 (as shown in the upper graph of FIG. 16).

Therefore, an ideal waveform W2 having the same phase as the sampled light sensitive waveform W1 may fail to be extracted as a matched ideal waveform W2' at step S12. That is, an ideal waveform W2 having a different phase from the sampled light sensitive waveform W1 may be extracted incorrectly. For this reason, different ideal waveforms W2 are prepared for different colors in the present aspect.

Thus, in the present aspect, second displacement amounts D2Y, D2M and D2C are determined individually for the respective chromatic colors, so that the first displacement amounts D1Y, D1M, D1C for the chromatic colors can be corrected using the respective second displacement amounts D2Y, D2M and D2C.

However, alternatively, the first displacement amounts D1Y, D1M, D1C for respective chromatic colors may be corrected commonly using a second displacement amount D2Y, D2M or D2C determined by a second displacement amount determination process executed for one of the chromatic colors.

Referring to FIG. 9, at step S40, the CPU 77 determines conclusive displacement amounts DY, DM and DC for respective chromatic colors based on the first displacement amounts D1Y, D1M and D1C calculated at step S20 and the second displacement amounts D2Y, D2M and D2C calculated at step S30.

At step S50, error compensation amounts CDY, CDM and CDC are calculated, for example, by subtracting the respective first displacement amounts D1Y, D1M, D1C from the respective conclusive displacement amounts DY, DM and DC. The error compensation amounts CDY, CDM and CDC are stored in the NVRAM 83 at step S60.

The process for determination of a second displacement amount may be executed before step S20, instead of after step S20.

(Effect of the Present Illustrative Aspect)

The detection of a displacement amount based on a corrective pattern 131 of the present aspect is insensitive to hysteresis or splashed toner. That is, the second displacement amounts D2Y, D2M and D2C determined according to the present aspect should be almost free of the effects of hysteresis or splashed toner, and therefore indicate the actual displacement amounts.

Therefore, in the present aspect, the first displacement amounts D1Y, D1M and D1C are corrected based on the second displacement amounts D2Y, D2M and D2C, so that the conclusive displacement amounts DY, DM and DC can be determined accurately without being affected by hysteresis or splashed toner.

However, a relatively large amount of toner is required for forming a corrective pattern 131, because the corrective pattern 131 includes a relatively large number of mark pairs 137. Therefore, in the present aspect, a corrective pattern 131 can be formed only when the execution condition is satisfied, as shown in FIG. 9.

In the present aspect, a matched ideal waveform W2' is extracted from the plurality of ideal waveforms W2 based on degree of coincidence with the sampled light sensitive waveform W1, so that the second displacement amount D2Y, D2M or D2C of an image formed of the adjustive color can be determined based on the matched ideal waveform W2', instead of the sampled light sensitive waveform W1. Thereby, even when the sampled light sensitive waveform W1 includes noise as shown by a dotted line in the upper graph of FIG. 15, the effect of the noise can be suppressed.

In the present aspect, optical sensors 111 are used for obtaining the binary signals S2, and the sampled light sensitive waveform W1 is generated based on the pulse widths of the binary signals S2. Instead of optical sensors 111, a density sensor can be used for sampling the peak value of a light amount reflected from the detection area E, and thereby a waveform based on the peak values may be generated as a sampled light sensitive waveform.

However, a density sensor capable of detecting the peak value of a received light amount is more expensive, compared to optical sensors 111. According to the present aspect, acquisition of a sampled light sensitive waveform W1 can be achieved using optical sensors 111, which are relatively inexpensive.

In the case of a conventional construction wherein a displacement amount is estimated directly based on the values measured from a corrective pattern 131 (without using the ideal waveforms), the displacement amount can be determined in a unit corresponding to the minimal difference between mark shift amounts. Therefore, the difference between the mark shift amounts of adjacent mark pairs 137 should be set to be smaller (i.e., a larger number of marks should be formed as a corrective pattern 131) in order to determine the displacement amount in higher precision.

In contrast, according to the present aspect, a second displacement amount D2Y, D2M or D2C is estimated based on a matched ideal waveform W2', which is extracted from the plurality of ideal waveforms W2 by comparison with the sampled light sensitive waveform W1. Therefore, the precision of determination of a second displacement amount D2Y, D2M or D2C can be increased by setting the phase difference Δt1 to a smaller value (i.e., by increasing the number of ideal waveforms W2 used for comparison), without increasing a number of marks 133, 135 to be formed.

In the present aspect, the phase difference Δt1 is set to be smaller than the sampling interval Δt2, and thereby the second displacement amount D2Y, D2M or D2C can be determined in a unit smaller than the minimal difference between the mark shift amounts. A desired precision can be achieved by setting the phase difference Δt1 to a value corresponding to the desired precision.

<Other Illustrative Aspects>

The present invention is not limited to the illustrative aspects explained in the above description made with reference to the drawings. The following aspects may be included in the technical scope of the present invention, for example.

(1) In the above aspects, the reflectivity of the belt 31 (as an object) is higher than that of an image formed area. However, conversely, the reflectivity of the belt 31 may be lower than that of an image formed area.

In this case, when the detection area E includes a larger exposed area of the belt 31, a light amount reflected from the detection area E is lower, and therefore the level of a light sensitive signal S1 is higher. When the detection area E includes a larger mark-formed area of the belt 31, a light amount reflected from the detection area E is higher, and therefore the level of a light sensitive signal S1 is lower.

Accordingly, binary signals S2 indicate a length of time before a light sensitive signal S1 exceeds the first threshold TH1 after falling below the second threshold TH2 in this case, contrary to the above aspects wherein binary signals S2 indicate a length of time before a light sensitive signal S1 falls below the second threshold TH2 after exceeding the first threshold TH1.

Further, the waveform of a light sensitive signal S1 during detection of a chromatic mark 119Y, 119M, 119C (or 127Y, 127M, 127C in the aspect 1) is larger in height and therefore in slope of level change in this case, contrary to the above aspects wherein the waveform of a light sensitive signal S1 during detection of an achromatic mark 119K (or 127K in the aspect 1) is larger in height and therefore in slope of level change.

(2) In the above aspects, the conclusive displacement amounts DY, DM and DC determined at step S40 or S80 are automatically used for correcting the displacement (i.e., used for adjusting the timing of emission of laser beams L from the scanner unit 23).

However, the present invention is not limited to this construction, but rather may be configured so that correction of displacement is not automatically performed. In this construction, when any of the conclusive displacement amounts DY, DM and DC exceeds a predetermined value, the CPU 77 can send a signal to the display section 87 of the printer 1 to warn a user, for example.

(3) In the above aspects, a color laser printer of a direct-transfer type is shown as an image forming apparatus. However, the present invention can be applied to other types of image forming apparatuses such as a laser printer of an intermediate-transfer type or an ink-jet printer. Further, the present invention may be applied to a printer that uses colorants of two or three colors, or colorants of five or more colors.

(4) In the above aspects, the marks of a registration pattern 121 or a corrective pattern 125 or 131 formed on the paper conveyer belt 31 (as an object) are detected for obtaining a light sensitive signal S1. However, instead of the belt 31, a registration pattern 121 or a corrective pattern 125 or 131 may be formed on a recording medium 7 (i.e., an example of "an object" of the present invention) such as paper or an OHP sheet to be conveyed by the belt 31.

Further, in the case of a printer of an intermediate-transfer type having an intermediate-transfer belt onto which a developer image on a photosensitive drum (as an image carrier) is directly transferred, the marks of a registration pattern 121 or a corrective pattern 125 or 131 as an image on the intermediate-transfer belt (i.e., an example of "an object" of the present invention) may be detected for obtaining a light sensitive signal S1.

(5) In the above aspects, the hysteresis comparator 117 is used to eliminate the influence of noise that can be included in a light sensitive signal S1. That is, two different thresholds TH1, TH2 are used for generating a binary signal S2 from a light sensitive signal S1. However, the first and second thresholds TH1, TH2 may be set to the same value.

In this case, variation in detected mark positions cannot be due to hysteresis. However, the detected mark positions may still vary due to splashed toner, as described above. Therefore, in order that degradation in accuracy of displacement correction due to the variation in detected mark positions may be suppressed, the present invention can be applied to an image forming apparatus in which the first and second thresholds TH1, TH2 are set to the same value.

(6) In the above aspects, the two first marks 119 of a mark pair 123 form different angles with respect to the shape of the detection area E of the optical sensor 111, and thereby the slope of level change of a light sensitive signal S1 during detection of the first-printed first mark 119*f* is smaller than that during detection of the second-printed first mark 119*s*.

However, the present invention can be applied to an image forming apparatus in which the detection area E of an optical sensor 111 can be formed so that the slope of level change of a light sensitive signal S1 during detection of the first-printed first mark 119*f* is equal to that during detection of the second-printed first mark 119*s*.

In this case, the slope of level change of a light sensitive signal S1 could differ among mark pairs 123 of different colors, because the reflectivity differs depending on colors as described above.

Therefore, variation in detected positions of mark pairs 123 due to hysteresis or splashed toner differs depending on colors of mark pairs 123. This could result in errors in the first displacement amounts in the secondary scanning direction D1, which are determined based on the relative distances between mark pairs 123. Accordingly, the present invention can be effective in this case.

(7) In the above aspect 1, the shape and colors of a corrective pattern 125 are symmetrical to the shape and colors of a registration pattern 121 with respect to a line parallel to the secondary scanning direction D1. However, a corrective pattern 125 is not limited to this construction.

What is required is that each second mark 127 of a corrective pattern 125 and the corresponding first mark 119 of a registration pattern 121 differ from each other in orientation so that the detected position of the first-printed second mark 127*f* of each mark pair 129 varies in a similar manner to the detected position of the second-printed first mark 119*s* of the corresponding mark pair 123 while the detected position of the second-printed second mark 127*s* varies in a similar manner to the detected position of the first-printed first mark 119*f*.

(8) In the above aspect 1, a corrective pattern 125 includes the same number of marks 127 as the number of marks 119 of a registration pattern 121. However, marks included in a corrective pattern 125 may be reduced in order to reduce toner usage. For example, a corrective pattern 125 can include one mark pair group that includes four mark pairs of respective colors.

(9) In the above aspects, the marks 119 of each mark pair 123 of a registration pattern 121 are symmetrical to each other with respect to a line parallel to the main scanning direction D2. However, the mark pairs 123 of a registration pattern 121 are not limited to this construction. What is required is that the marks 119 of each mark pair 123 form different angles with the above line from each other.

(10) In the above aspect 1, a corrective pattern 125 includes mark pairs 129 of three adjustive colors. However, the corrective pattern is not limited to this construction, but rather may include mark pairs of one adjustive color.

In this case, an error compensation amount for the adjustive color is calculated based on the corrective pattern so as to be used as a common error compensation amount for correcting first displacement amounts D1Y, D1M and D1C calculated for the three adjustive colors.

It is also preferable in this case that an achromatic color (i.e., black) is used as the reference color while chromatic colors are used as the adjustive colors, as in the above aspects. Further, in order to suppress the effect of movement fluctuation of the belt 31 described above, the mark pairs as the above mark pairs of one adjustive color included in the corrective pattern are preferably formed by a processing unit (e.g. the processing unit 25C for cyan (i.e., a first chromatic color) in the case of a printer 1 shown in FIG. 1) as close as possible to the processing unit 25K that forms mark pairs of the reference color.

(11) In the above aspect, the achromatic color (i.e., black) is used as a reference color while chromatic colors are used as adjustive colors. This construction is sometimes preferable, because the reflectivities of the chromatic colors are approximate to one another but substantially different from that of the achromatic color.

For example, in the above aspect 1, the first displacement amounts D1Y, D1M and D1C for respective chromatic colors may be corrected commonly using the second displacement amount D2Y, D2M or D2C determined by a second displacement amount determination process executed for one of the chromatic colors, as described above.

However, the present invention is not limited to this construction. For example, one of the chromatic colors may be used as a reference color.

(12) In the above aspect 2, the sum total of inner products of the data points on the sampled light sensitive waveform W1 and the corresponding data points on each ideal waveform W2 is calculated, and one ideal waveform corresponding to the largest sum total is extracted as a matched ideal waveform W2'. However, the present invention is not limited to this construction.

For example, a plurality of ideal waveforms W2 corresponding to top sum totals may be extracted as matched ideal waveforms W2'. In this case, the average of displacement amounts corresponding to the plurality of matched ideal waveforms W2' can be determined at step S13 as a second displacement amount D2Y, D2M or D2C.

(13) In the above aspect 2, the second displacement amount D2Y, D2M or D2C in the main scanning direction D2 is determined using a corrective pattern 131 including reference-color marks 133 and adjustive-color marks 135 which are shifted from each other by different shift amounts in the main scanning direction D2. However, the present invention is not limited to this construction.

Alternatively or additionally, the second displacement amount in the secondary scanning direction D1 may be determined using a corrective pattern including reference-color marks and adjustive-color marks which are shifted from each other by different shift amounts in the secondary scanning direction D1.

What is claimed is:

1. An image forming apparatus comprising:

a forming portion configured to form an image on an object based on image data, said object being capable of movement relative to said forming portion;

a control portion configured to provide data of a mark as said image data for said forming portion;

a light receiving portion configured to receive light from a detection area, a level of said light varying with time while an image formed on said object moves across said detection area with said relative movement of said object;

a determining portion configured to determine a position of said mark in a relative movement direction of said object based on comparison of a time-varying level of said light with at least one threshold during movement of said mark on said object across said detection area;

a correcting portion configured to correct said determined position of said mark by a correction value into a corrected mark position, said correction value being set to a higher value if a slope of level change of said light when the level of said light exceeds said threshold or falls below said threshold is smaller while said mark on said object moves across said detection area; and an adjusting portion configured to adjust a position of an image to be formed by said forming portion based on said corrected mark position.

2. An image forming apparatus comprising:

a forming portion configured to form an image on a belt based on image data including image data of a first mark pair containing two first marks and image data of a second mark pair containing two second marks corresponding to said two first marks and having a shape symmetrical to a shape of said first mark pair, said belt being capable of cyclic rotational movement relative to said forming portion;

a control portion configured to provide said image data of said first mark pair and said image data of said second mark pair for said forming portion, determine whether a reference point of said belt is at a predetermined position, cause said forming portion to form an image of said first mark pair on an area of said belt when the reference point of said belt is at the predetermined position during a first cycle of said cyclic rotational movement of said belt, and cause said forming portion to form an image of said second mark pair on said area when said reference point is at said predetermined position during a second cycle of said cyclic rotational movement;

a light receiving portion configured to receive light from a detection area, a level of said light varying with time while an image formed on said belt moves across said detection area with said relative movement of said belt;

a first determining portion configured to determine a first distance between said two first marks based on comparison of a time-varying level of said light with at least one threshold during movement of said first mark pair on said belt across said detection area;

a second determining portion configured to determine a second distance between said two second marks based on comparison of a time-varying level of said light with said at least one threshold during movement of said second mark pair on said belt across said detection area;

a correcting portion configured to correct said first distance based on said second distance into a corrected distance; and a displacement determining portion configured to determine an estimated displacement amount of an image to be formed by said forming portion based on said corrected distance.

3. An image forming apparatus as in claim 2, wherein:

each of said two first marks includes a linear section, and said two first marks differ in orientation of the linear section from each other; and each of said two second marks includes a linear section, and said two second marks differ in orientation of the linear section from each other.

4. An image forming apparatus as in claim 2, wherein the shape of said second mark pair is symmetrical to the shape of said first mark pair with respect to a line parallel to a relative movement direction of said object.

5. An image forming apparatus as in claim 2, wherein said displacement determining portion determines, as said estimated displacement amount, an estimated displacement amount in a first direction perpendicular to said relative movement direction.

6. An image forming apparatus as in claim 2, further comprising an adjusting portion configured to adjust, based on said estimated displacement amount, a position of an image to be formed by said forming portion in a first direction perpendicular to said relative movement direction.

7. An image forming apparatus as in claim 2, wherein:

said first marks are formed as adjacent marks arranged along a relative movement direction of said object; and said second marks are formed as adjacent marks arranged along said relative movement direction of said object.

8. An image forming apparatus comprising:

a forming portion configured to form an image on an object based on image data including image data of a plurality of first mark pairs and image data of a plurality of second mark pairs, each first mark pair containing two first marks, each second mark pair containing two second marks corresponding to said two first marks and having a shape symmetrical to a shape of said first mark pair, a number of said plurality of first mark pairs is larger than a number of said plurality of second mark pairs, said object being capable of cyclic rotational movement relative to said forming portion;

a light receiving portion configured to receive light from a detection area, a level of said light varying with time while an image formed on said object moves across said detection area with said relative movement of said object;

a control portion configured to provide said image data for said forming portion;

a first determining portion configured to determine a first distance between said two first marks based on comparison of a time-varying level of said light with at least one threshold during movement of said first mark pairs on said object across said detection area;

a second determining portion configured to determine a second distance between said two second marks based on comparison of a time-varying level of said light with said at least one threshold during movement of said second mark pairs on said object across said detection area;

a correcting portion configured to correct said first distance based on said second distance into a corrected distance; and a displacement determining portion configured to determine an estimated displacement amount of an image to be formed by said forming portion based on said corrected distance.

9. An image forming apparatus as in claim 2, wherein:

the image data includes a plurality of first mark pairs;

the image data includes a plurality of second mark pairs;

said control portion causes said forming portion to form at least one of said first mark pairs in a first chromatic color and at least another one of said first mark pairs in a second chromatic color, and to form at least one of said second mark pairs in said first chromatic color; and said correcting portion corrects said first distances, which are determined respectively from said first mark pair of said first chromatic color and said first mark pair of said second chromatic color, based on said second distance determined from said second mark pair of said first chromatic color.

10. An image forming apparatus as in claim 9, wherein:

said control portion causes said forming portion to form at least one of said first mark pairs in an achromatic color, and to form at least one of said second mark pairs in said achromatic color; and said displacement determining portion determines, as said estimated displacement amount, an estimated displacement amount of an image to be formed of each of said first and second chromatic colors from an image to be formed of said achromatic color.

11. An image forming apparatus as in claim 10, wherein said forming portion is capable of forming an image of said first chromatic color by a processing unit that is positioned closer to a processing unit used for forming an image of said achromatic color compared to a processing unit used for forming an image of said second chromatic color.

12. An image forming apparatus comprising:

a forming portion configured to form an image on an object based on image data including image data of a first mark pair containing two first marks and image data of a second mark pair containing two second marks corresponding to said two first marks and having a shape symmetrical to a shape of said first mark pair, said object being capable of cyclic rotation movement relative to said forming portion;

a light receiving portion configured to receive light from a detection area, a level of said light varying with time while an image formed on said object moves across said detection area with said relative movement of said object;

a control portion configured to provide said image data for said forming portion;

a first determining portion configured to determine a first distance between said two first marks based on comparison of a time-varying level of said light with at least one threshold during movement of said first mark pair on said object across said detection area;

a second determining portion configured to determine a second distance between said two second marks based on comparison of a time-varying level of said light with said at least one threshold during movement of said second mark pair on said object across said detection area; and a third determining portion configured to determine, based on said first distance and said second distance, an error compensation amount which is to be used for correcting a first distance between said first marks during a future process; and a storage portion configured to store said error compensation amount; and a decision portion configured to determine whether a predetermined execution condition is satisfied, wherein:

said control portion causes said forming portion to cancel formation of said second mark pair if said decision portion determines that said predetermined execution condition is not satisfied; and said correcting portion corrects said first distance using said error compensation amount stored in said storage portion if said decision portion determines that said predetermined execution condition is not satisfied.

13. An image forming apparatus comprising:

a forming portion configured to form an image on an object based on image data including image data of a first mark pair containing two first marks and image data of a second mark pair containing two second marks corresponding to said two first marks and having a shape symmetrical to a shape of said first mark pair, said object being capable of cyclic rotational movement relative to said forming portion;

a control portion configured to provide said image data for said forming portion;

a light receiving portion configured to receive light from a detection area, a level of said light varying with time while an image formed on said object moves across said detection area with said relative movement of said object;

a first determining portion configured to determine a first distance between said two first marks based on a time when a time-varying level of light exceeds a first threshold and a time when the time-varying level of said light falls below a second threshold during movement of said first mark pair on said object across said detection area; and a second determining portion configured to determine a second distance between said two second marks based on a time when a time-varying level of said light exceeds said first threshold and a time when the time-varying level of said light falls below said second threshold during movement of said second mark pair on said object across said detection area.

14. An image forming apparatus comprising:

a forming portion configured to form an image on an object based on image data, said object being capable of movement relative to said forming portion;

a control portion configured to provide data of a mark as said image data for said forming portion;

a light receiving portion configured to receive light from a detection area, a level of said light varying with time while an image formed on said object moves across said detection area with said relative movement of said object;

a first determining portion configured to determine a position of said mark in a relative movement direction of said object based on a time when a level of light received by said light receiving portion exceeds a first threshold and a time when the level of said light falls below a second threshold;

a correcting portion configured to correct said position of said mark determined by said first determining portion into a corrected mark position;

an adjusting portion configured to adjust a position of an image to be formed by said forming portion based on said corrected mark position, wherein:

said control portion provides data of a mark of a reference color and a mark of an adjustive color as data of said mark, and further provides data of a pattern as said image data, said pattern including a plurality of mark pairs, each of said plurality of mark pairs including a mark of said reference color and a mark of said adjustive color, said plurality of mark pairs differing from one another in mark shift amount that is a shift amount of said adjustive-color mark from said reference-color mark; and a second determining portion configured to determine a position of said adjustive-color mark relative to a position of said reference-color mark based on a level of light that is received by said light receiving portion and varies with time while said pattern on said object moves across said detection area, wherein:

said correcting portion corrects said position of said mark determined by said first determining portion into said corrected mark position based on said position of said adjustive-color mark determined by said second determining portion; and said adjusting portion adjusts a position of an image to be formed of said adjustive color with respect to a position of an image to be formed of said reference color, based on said corrected mark position.

15. An image forming apparatus as in claim 14, further comprising a decision portion configured to determine whether a predetermined execution condition is satisfied, wherein:

said forming portion forms said reference-color mark and said adjustive-color mark as said mark on said object and further forms said pattern on said object, if said decision portion determines that said predetermined execution condition is satisfied;

said forming portion cancels formation of said pattern if said decision portion determines that said predetermined execution condition is not satisfied;

said correcting portion corrects said determined position of said mark based on said determined position of said adjustive-color mark of said pattern that is formed during a current process, if said decision portion determines that said predetermined execution condition is satisfied; and said correcting portion corrects said determined position of said mark based on a determined position of said adjustive-color mark of said pattern that is formed during a previously-executed process, if said decision portion determines that said predetermined execution condition is not satisfied.

16. An image forming apparatus comprising:

a forming portion configured to form an image on an object based on image data, said object being capable of movement relative to said forming portion;

a light receiving portion configured to receive light from a detection area, a level of said light varying with time while an image formed on said object moves across said detection area with said relative movement of said object;

a processing unit;

memory having executable instructions stored therein that, when executed by the processing unit, cause the image forming apparatus to operate as a control portion configured to provide data of a mark as said image data for said forming portion;

a determining portion configured to determine a position of said mark in a relative movement direction of said object based on comparison of a time-varying level of said light with at least one threshold during movement of said mark on said object across said detection area;

a correcting portion configured to correct said determined position of said mark by a correction value into a corrected mark position, said correction value being set to a higher value if a slope of level change of said light when the level of said light exceeds said threshold or falls below said threshold is smaller while said mark on said object moves across said detection area; and an adjusting portion configured to adjust a position of an image to be formed by said forming portion based on said corrected mark position.

17. An image forming apparatus comprising:

a forming portion configured to form an image on a belt based on image data including image data of a first mark pair containing two first marks and image data of a second mark pair containing two second marks corresponding to said two first marks and having a shape symmetrical to a shape of said first mark pair, said belt being capable of cyclic rotational movement relative to said forming portion;

a light receiving portion configured to receive light from a detection area, a level of said light varying with time while an image formed on said belt moves across said detection area with said relative movement of said belt;

a processing unit;

memory having executable instructions stored therein that, when executed by the processing unit, cause the image forming apparatus to operate as a control portion configured to provide said image data of said first mark pair and said image data of said second mark pair for said forming portion, determine whether a reference point of said belt is at a predetermined position, cause said forming portion to form an image of said first mark pair on an area of said belt when the reference point of said belt is at the predetermined position during a first cycle of said cyclic rotational movement of said belt, and cause said forming portion to form an image of said second mark pair on said area when said reference point is at said predetermined position during a second cycle of said cyclic rotational movement;

a first determining portion configured to determine a first distance between said two first marks based on comparison of a time-varying level of said light with at least one threshold during movement of said first mark pair on said belt across said detection area;

a second determining portion configured to determine a second distance between said two second marks based on comparison of a time-varying level of said light with said at least one threshold during movement of said second mark pair on said belt across said detection area;

a correcting portion configured to correct said first distance based on said second distance into a corrected distance; and a displacement determining portion configured to determine an estimated displacement amount of an image to be formed by said forming portion based on said corrected distance.

18. An image forming apparatus comprising:

a forming portion configured to form an image on an object based on image data including image data of a plurality of first mark pairs and image data of a plurality of second mark pairs, each first mark pair containing two first marks, each second mark pair containing two second marks corresponding to said two first marks and having a shape symmetrical to a shape of said first mark pair, a number of said plurality of first mark pairs is larger than a number of said plurality of second mark pairs, said object being capable of cyclic rotational movement relative to said forming portion;

a light receiving portion configured to receive light from a detection area, a level of said light varying with time while an image formed on said object moves across said detection area with said relative movement of said object;

a processing unit;

memory having executable instructions stored therein that, when executed by the processing unit, cause the image forming apparatus to operate as a control portion configured to provide said image data for said forming portion;

a first determining portion configured to determine a first distance between said two first marks based on comparison of a time-varying level of said light with at least one threshold during movement of said first mark pairs on said object across said detection area;

a second determining portion configured to determine a second distance between said two second marks based on comparison of a time-varying level of said light with said at least one threshold during movement of said second mark pairs on said object across said detection area;

a correcting portion configured to correct said first distance based on said second distance into a corrected distance; and a displacement determining portion configured to determine an estimated displacement amount of an image to be formed by said forming portion based on said corrected distance.

19. An image forming apparatus comprising:

a forming portion configured to form an image on an object based on image data including image data of a first mark pair containing two first marks and image data of a second mark pair containing two second marks corresponding to said two first marks and having a shape symmetrical to a shape of said first mark pair, said object being capable of cyclic rotation movement relative to said forming portion;

a light receiving portion configured to receive light from a detection area, a level of said light varying with time while an image formed on said object moves across said detection area with said relative movement of said object;

a processing unit;

memory having executable instructions stored therein that, when executed by the processing unit, cause the image forming apparatus to operate as a control portion configured to provide said image data for said forming portion;

a first determining portion configured to determine a first distance between said two first marks based on comparison of a time-varying level of said light with at least one threshold during movement of said first mark pair on said object across said detection area;

a second determining portion configured to determine a second distance between said two second marks based on comparison of a time-varying level of said light with said at least one threshold during movement of said second mark pair on said object across said detection area; and a third determining portion configured to determine, based on said first distance and said second distance, an error compensation amount which is to be used for correcting a first distance between said first marks during a future process; and a storage portion configured to store said error compensation amount; and wherein the memory has further executable instructions stored therein that, when executed by the processing unit, cause the image forming apparatus to operate as a decision portion configured to determine whether a predetermined execution condition is satisfied, wherein:

said control portion causes said forming portion to cancel formation of said second mark pair if said decision portion determines that said predetermined execution condition is not satisfied; and said correcting portion corrects said first distance using said error compensation amount stored in said storage portion if said decision portion determines that said predetermined execution condition is not satisfied.

20. An image forming apparatus comprising:

a forming portion configured to form an image on an object based on image data, said object being capable of movement relative to said forming portion;

a light receiving portion configured to receive light from a detection area, a level of said light varying with time while an image formed on said object moves across said detection area with said relative movement of said object;

a processing unit;

memory having executable instructions stored therein that, when executed by the processing unit, cause the image forming apparatus to operate as a control portion configured to provide said image data for said forming portion;

a first determining portion configured to determine a position of said mark in a relative movement direction of said object based on a time when a level of light received by said light receiving portion exceeds a first threshold and a time when the level of said light falls below a second threshold;

a correcting portion configured to correct said position of said mark determined by said first determining portion into a corrected mark position;

an adjusting portion configured to adjust a position of an image to be formed by said forming portion based on said corrected mark position, wherein:

said control portion provides data of a mark of a reference color and a mark of an adjustive color as data of said mark, and further provides data of a pattern as said image data, said pattern including a plurality of mark pairs, each of said plurality of mark pairs including a mark of said reference color and a mark of said adjustive color, said plurality of mark pairs differing from one another in mark shift amount that is a shift amount of said adjustive-color mark from said reference-color mark; and a second determining portion configured to determine a position of said adjustive-color mark relative to a position of said reference-color mark based on a level of light that is received by said light receiving portion and varies with time while said pattern on said object moves across said detection area, wherein:

said correcting portion corrects said position of said mark determined by said first determining portion into said corrected mark position based on said position of said adjustive-color mark determined by said second determining portion; and said adjusting portion adjusts a position of an image to be formed of said adjustive color with respect to a position of an image to be formed of said reference color, based on said corrected mark position.

* * * * *